US012392079B2

(12) United States Patent
Yoon et al.

(10) Patent No.: US 12,392,079 B2
(45) Date of Patent: Aug. 19, 2025

(54) LAUNDRY TREATING APPARATUS

(71) Applicant: LG Electronics Inc., Seoul (KR)

(72) Inventors: Juhan Yoon, Seoul (KR); Junghwan Lee, Seoul (KR); Sanghun Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 866 days.

(21) Appl. No.: 17/666,182

(22) Filed: Feb. 7, 2022

(65) Prior Publication Data

US 2022/0251761 A1 Aug. 11, 2022

(30) Foreign Application Priority Data

Feb. 8, 2021 (KR) ..... 10-2021-0017344
Feb. 23, 2021 (KR) ..... 10-2021-0024266

(51) Int. Cl.
*D06F 58/08* (2006.01)
*D06F 58/06* (2006.01)
*D06F 58/26* (2006.01)

(52) U.S. Cl.
CPC ..... *D06F 58/08* (2013.01); *D06F 58/06* (2013.01); *D06F 58/26* (2013.01)

(58) Field of Classification Search
CPC ..... D06F 58/08; D06F 58/06; D06F 58/04; D06F 58/26
See application file for complete search history.

(56) References Cited

U.S. PATENT DOCUMENTS 8,011,211 B2 * 9/2011 Ahn ..... D06F 37/04 68/142
2005/0102853 A1 5/2005 Wang
2009/0211313 A1 8/2009 Exler et al.
2017/0191202 A1 7/2017 Lee et al.

FOREIGN PATENT DOCUMENTS

| | | |
|---|---|---|
| CN | 102884239 | 1/2013 |
| CN | 205012082 | 2/2016 |
| CN | 107904888 | 4/2018 |
| CN | 207362548 | 5/2018 |
| CN | 111041764 | 4/2020 |
| CN | 211284938 | 8/2020 |
| JP | H08-280995 | 10/1996 |
| JP | 2005-034163 | 2/2005 |
| JP | 2007-167263 | 7/2007 |

(Continued)

OTHER PUBLICATIONS

Office Action in Chinese Appln. No. 202210118022.2, mailed on Apr. 15, 2023, 16 pages (with English translation).

(Continued)

*Primary Examiner* — Jessica Yuen
(74) *Attorney, Agent, or Firm* — Fish & Richardson P.C.

(57) ABSTRACT

A laundry treatment apparatus includes a drum configured to receive laundry. The drum includes a cylindrical drum body and a rear cover defining a rear surface of the drum. The rear cover includes a plurality of rear-cover-reinforcing ribs that radially extend from a center of the rear cover and are connected to a periphery of the rear cover. The laundry treatment apparatus is configured to circulate hot and dry air through an inside of the drum.

20 Claims, 16 Drawing Sheets

(56) References Cited

FOREIGN PATENT DOCUMENTS

| | | |
|---|---|---|
| JP | 2014014584 | 1/2014 |
| KR | 20180135831 | 12/2018 |
| KR | 10-2019-0128466 | 11/2019 |
| KR | 20190128466 | 11/2019 |
| KR | 10-2020-0065931 | 6/2020 |
| KR | 20200065931 | 6/2020 |
| KR | 20200066169 | 6/2020 |
| WO | WO2004104288 | 12/2004 |
| WO | WO 2018/169353 | 9/2018 |

OTHER PUBLICATIONS

Extended European Search Report in European Appln. No. 22155548.5, dated Jun. 24, 2022, 10 pages.
International Search Report in International Appln. No. PCT/KR2022/001831, dated May 27, 2022, 10 pages.

* cited by examiner

2

LAUNDRY TREATING APPARATUS

CROSS-REFERENCE TO RELATED APPLICATIONS

This application claims the benefit of Korean Patent Application Nos. 10-2021-0017344, filed on Feb. 8, 2021, and 10-2021-0024266, filed on Feb. 23, 2021, the disclosures of which are hereby incorporated by reference as if fully set forth herein.

TECHNICAL FIELD

The present disclosure relates to a laundry treatment apparatus, and more particularly to a reinforcing rib configured to reinforce the rear surface of a drum.

BACKGROUND

A laundry treatment apparatus refers to an apparatus designed to wash and dry laundry and/or to remove wrinkles from laundry in a home or a laundromat. For example, a laundry treatment apparatus may include a washing machine configured to wash laundry, a dryer configured to dry laundry, a combined washing and dryer configured to perform both washing and drying, a laundry management machine configured to refresh laundry, and a steamer configured to remove wrinkles from laundry.

Dryers may be classified into an exhaustion-type dryer and a circulation-type dryer, which are both configured to perform a drying procedure including generating hot air using a heater and exposing laundry to the hot air to remove moisture from the laundry. For instance, the dryers may be configured to evaporate the moisture contained in an object to be treated, such as clothes, bedclothes and the like, received in a drum (or a tub) by supplying hot air to the object to be treated. Here, the dryers may be classified into a condensation type and an exhaustion type according to the method by which hot and humid air including moisture is treated.

In some cases, a dryer may be configured to perform a drying procedure and omit a structure for supplying water to laundry or discharging water. In some cases, a dryer may also omit a tub that receives water therein. The simplified internal structure of the dryer may improve drying efficiency by directly supplying hot air to a drum receiving laundry therein.

In some cases, a dryer may transmit rotational force to a drum to rotate the drum receiving laundry therein using a belt surrounding the drum. In some cases, the belt may not be capable of precisely controlling the rotational speed of the drum or changing the direction of rotation of the drum. In some cases, the dryer may reduce the drying time and improve drying efficiency by changing the rotational speed and the direction of rotation of the drum provided in the dryer.

In some examples, a dryer may have a structure in which hot air is introduced through a rear support defining the rear surface of a drum. In this structure, when the outer circumferential surface of the drum is rotated by means of a belt, hot air may be supplied through a portion of the rear supporter, that is, a crescent-shaped opening. In some cases, the hot air supplied through the portion of the rear support may not be rotated together with the drum during rotation of the drum. As a result, the period of time for which the hot air is in contact with laundry may be limited.

In some cases, a direct-coupling-type (or a direct-driving-type) dryer may include a motor directly connected to the rear side of a drum to order to change the rotational speed and rotational direction of the dryer drum. In some cases, components, which would conventionally be positioned below a drum to transmit power to the drum, may be omitted, thereby making it possible to enlarge a flow channel through which the hot air currents.

In some cases, when the intensity of airflow is increased due to the enlargement of the flow channel (for example, when the capacity of a fan is increased), laundry positioned in the drum may be pushed forwards. In this case, the laundry in the drum may not be normally mixed, thereby deteriorating drying efficiency. Particularly, in the case in which the lifter extends in forward and rearward directions, the laundry positioned in the drum may be agitated in the rotational direction of the drum, thereby deteriorating drying efficiency.

SUMMARY

The present disclosure describes a laundry treatment apparatus that can enable hot air to be supplied while being rotated during rotation of a drum.

The present disclosure describes a laundry treatment apparatus that can increase the rigidity of a rear cover to thus suppress twisting of the rear cover.

The present disclosure describes a laundry treatment apparatus that can help to prevent laundry from being adhered to the rear surface of a drum and thus from being damaged when hot air is supplied.

The present disclosure describes a laundry treatment apparatus capable of efficiently agitating laundry during rotation of a drum.

The present disclosure describes a laundry treatment apparatus that can agitate the laundry positioned in a drum in forward and rearward directions and in the rotational direction of the drum.

The present disclosure describes a laundry treatment apparatus that can agitate the heated air in a drum by virtue of rotation of the drum.

The present disclosure describes a laundry treatment apparatus that can help to prevent laundry, which is agitated in a drum, from becoming stuck inside the drum.

According to one aspect of the subject matter described in this application, a laundry treatment apparatus includes a drum that is configured to receive laundry and includes a drum body that has a cylindrical shape and a rear cover that defines a rear surface of the drum, and a drive unit including a drum shaft configured to rotate the drum. The rear cover includes a rear cover central portion that protrudes toward an inside of the drum and defines a rear cover through-hole passing through the rear cover in an axial direction of the drum shaft, a rear cover peripheral portion that defines an outer circumference of the rear cover, a plurality of rear-cover-reinforcing ribs that connect the rear cover central portion to the rear cover peripheral portion in a radial direction of the drum shaft, and a rear cover recess disposed between the plurality of rear-cover-reinforcing ribs, where the rear cover recess is recessed away from the drum relative to the plurality of rear-cover-reinforcing ribs in the axial direction, and the rear cover defines a plurality of air introduction holes at the rear cover recess.

Implementations according to this aspect can include one or more of the following features. For example, the rear cover peripheral portion can include a rear cover rim that has a ring shape and is connected to the plurality of rear-cover-reinforcing ribs, and a rear cover side surface that extends radially outward from the rear cover rim, where the rear cover side surface is bent from the rear cover rim and coupled to the drum body. In some examples, a distance from the rear cover recess to the rear cover rim in the axial direction can be equal to a distance from the rear cover recess to the plurality of rear-cover-reinforcing ribs in the axial direction. In other words, the rear cover rim and the plurality of rear-cover-reinforcing ribs can be located at the same axial position. In some examples, a radial width of the rear cover rim in the radial direction can be less than a radial width of the rear cover recess in the radial direction.

In some examples, the rear cover can further include a plurality of rear cover recesses that are disposed radially between the rear cover rim and the rear cover central portion and disposed between the plurality of rear-cover-reinforcing ribs in a circumferential direction of the rear cover, where the rear cover recess is one of the plurality of rear cover recesses.

In some implementations, a distance from the rear cover recess to the plurality of rear-cover-reinforcing ribs in the axial direction can be less than or equal to a distance from the rear cover recess to a portion of the rear cover central portion having the rear cover through-hole in the axial direction. In other words, the rear cover central portion can protrudes toward the inside of the drum relative to the plurality of rear-cover-reinforcing ribs in the axial direction.

In some implementations, the rear cover central portion can include a central flat surface that defines the rear cover through-hole, and a central side surface that extends radially outward from a periphery of the central flat surface and surrounds the central flat surface, where the plurality of rear-cover-reinforcing ribs extend outward from the central side surface in the radial direction. In some examples, the central side surface can include a curved surface. In some implementations, a distance from the rear cover recess to the plurality of rear-cover-reinforcing ribs in the axial direction can be less than or equal to a distance from the rear cover recess to the central flat surface in the axial direction. In some implementations, boundaries of the plurality of rear-cover-reinforcing ribs have a round shape and are connected to the rear cover recess.

In some implementations, the laundry treatment apparatus can include a lifter disposed on an inner circumferential surface of the drum body and configured to interfere with the laundry based on rotation of the drum, where a longitudinal axis of the lifter passes through the rear cover and is disposed between two of the plurality of rear-cover-reinforcing ribs. In some examples, the lifter extends in the axial direction and has a curved shape. In some examples, the lifter can protrude from the inner circumferential surface of the drum body toward a rotational center of the drum body, and a side surface of the lifter can be tapered toward the rotational center of the drum body.

In some implementations, the lifter extends in the axial direction and has a stepped shape, where the lifter has a plurality of lifting surfaces including a first lifting surface that extends in the axial direction, a second lifting surface that extends from the first lifting surface and is inclined with respect to the first lifting surface, and a third lifting surface that extends from the second lifting surface in the axial direction to thereby define a step with respect to the first lifting surface in a circumferential direction of the drum body.

In some implementations, the laundry treatment apparatus can include a drying unit configured to circulate air through the drum, where the drying unit is configured to supply the air to the drum to thereby absorb moisture from the laundry. For instance, the drying unit can include an exhaust passage configured to receive the air discharged from the drum, a heat-exchanging unit disposed in the exhaust passage and configured to dehumidify the air and then heat the air, and a supply passage configured to guide the air from the exhaust passage toward the drum.

In some implementations, the drive unit can further include a motor including a stator configured to generate a rotating field and a rotor configured to be rotated by the rotating field, a rotor shaft disposed between the rear cover and the motor, the rotor shaft having one end fixed to the rotor and configured to be rotated by the rotor, and a power transmission unit including one or more gears that are configured to transmit rotational power of the rotor shaft to the drum shaft.

In some implementations, the laundry treatment apparatus can include a shaft bracket that is fixed to the rear cover and covers the rear cover through-hole, where the shaft bracket is coupled to the drum shaft and configured to transmit rotational power from the drum shaft to the drum, and a rotating-shaft-coupling member that couples the drum shaft to the shaft bracket. The shaft bracket can define a shaft-coupling hole such that the drum shaft can be inserted into the shaft-coupling hole and protrude toward the drum.

In some implementations, the laundry treatment apparatus can include a protective cover that is disposed in the drum and covers the drum shaft and the shaft bracket. In some implementations, the rotating-shaft-coupling member can have a cylindrical shape and protrude from a front surface of the shaft bracket toward the drum, where the rotating-shaft-coupling member defines an inner thread at an inner circumferential surface thereof, and an end portion of the drum shaft has an outer thread coupled to the inner thread.

In some implementations, air introduction holes can be defined at a portion depressed in the outward direction of the drum and supply hot air to the rear surface of the drum. The rear-cover-reinforcing ribs can increase the rigidity of the rear cover and can project forwards further than the depressed portion in which the air introduction holes are formed. In other words, the present disclosure provides a laundry treatment apparatus having a difference in height between the rear-cover-reinforcing ribs and the depressed portion.

In some examples, the rear-cover-reinforcing ribs can serve as wings of a kind of fan for rotating air introduced through the air introduction holes. In other words, the rear-cover-reinforcing ribs are capable not only of increasing the rigidity of the rear cover but also of rotating the air introduced into the drum in the circumferential direction during rotation of the drum.

The air, which is rotated by the rear-cover-reinforcing ribs (or bridges), can be in contact with rotating laundry for a long period of time, thereby improving the drying performance of the laundry treatment apparatus.

In some implementations, the laundry treatment apparatus includes the air introduction holes formed through the rear cover, the drying unit configured to supply heated air toward the air introduction holes from the outside of the drum, the drive unit configured to rotate the drum in a main rotational direction, which is set to be one of a clockwise direction and a counterclockwise direction, and a lifter provided on the inner circumferential surface of the drum body so as to agitate laundry.

The lifter can include a portion that extends toward a front cover from a rear cover and is inclined in the main rotational direction. When the drum is rotated in the main rotational direction, the lifter can guide the laundry toward the rear cover.

The drive unit can include the motor, fixed to a fixed panel and generating rotational force, and the drum shaft, which is connected at one end thereof to the motor and at the other end thereof to the rear cover so as to transmit the rotational force of the motor to the drum.

The drum body can include an anti-slip portion formed on the inner circumferential surface thereof so as to be convex or concave in order to prevent slippage of laundry, and a slip-inducing portion, which is defined as a portion of the inner circumferential surface of the drum body on which the anti-slip portion is not formed.

In some implementations, the slip-inducing portion can include a first slip-inducing portion, which extends not only in the longitudinal direction of the drum shaft but also in the clockwise direction or in the counterclockwise direction at the rear end of the drum body, and a second slip-inducing portion, which extends from the first slip-inducing portion in the longitudinal direction of the drum shaft and to which the lifter is coupled.

The anti-slip portion can include a first anti-slip portion, which is convex from the inner circumferential surface of the drum body, and a second anti-slip portion, which is concave from the inner circumferential surface of the drum body and has a size smaller than that of the first anti-slip portion.

In some implementations, the rear cover can include a drive recess, which projects forwards and to which the drum shaft is coupled, a plurality of rear cover ribs radially extending from the drive recess, and an introduction plate, which is provided between the plurality of rear cover ribs and through which the air introduction holes are formed.

In some examples, the lifter can be provided at a location that is spaced apart from an introduction plate in the longitudinal direction of the drum shaft. The lifter can be provided at a location that overlaps the air introduction holes in the longitudinal direction of the drum shaft. The drive recess can be rounded. The introduction plate can project rearwards further than the plurality of rear cover ribs. The lifter can project toward the rotational center of the drum body from the inner circumferential surface of the drum body and can be tapered in the direction in which the lifter projects.

The lifter can include a fixed surface, which is brought into contact with the inner circumferential surface of the drum body, a projecting surface, which is spaced apart from the fixed surface toward the rotational center of the drum body, and an extending surface extending between the fixed surface and the projecting surface.

In some examples, a first portion of the lifter, which is positioned before the center of the length of the drum body in the longitudinal direction of the drum shaft, may, in the main rotational direction of the drum shaft, be spaced apart from a second portion of the lifter, which is positioned behind the center of the length of the drum body in the longitudinal direction of the drum shaft.

In some examples, the projecting surface can include a first projecting lifting surface, which extends from the rear side of the drum body in the longitudinal direction of the drum shaft, a second projecting lifting surface, which obliquely extends from the first projecting lifting surface in a direction which is inclined in the main rotational direction, and a third projecting lifting surface, which extends from the second projecting lifting surface in the longitudinal direction of the drum shaft. The fixed surface can extend in the longitudinal direction of the drum shaft. The second projecting lifting surface can be positioned at the center of the length of the drum body in the longitudinal direction of the drum shaft.

In some examples, the projecting surface can include a first projecting lifting surface that extends from the rear side of the drum body in the longitudinal direction of the drum shaft, a second projecting lifting surface that extends from the first projecting lifting surface in a direction which is inclined in the main rotational direction, a third projecting lifting surface that extends from the second projecting lifting surface in the longitudinal direction of the drum shaft, a fourth projecting lifting surface that extends from the third projecting lifting surface in a direction which is inclined in the main rotational direction, and a fifth projecting lifting surface that extends from the fourth projecting lifting surface in the longitudinal direction of the drum shaft.

In some implementations, the fixed surface can include a first fixed lifting surface that extends from the rear side of the drum body in the longitudinal direction of the drum shaft, a second fixed lifting surface that extends from the first fixed lifting surface in a direction which is inclined in the main rotational direction, a third fixed lifting surface that extends from the second fixed lifting surface in the longitudinal direction of the drum shaft, a fourth fixed lifting surface that extends from the third fixed lifting surface in a direction which is inclined in the main rotational direction, and a fifth fixed lifting surface that extends from the fourth fixed lifting surface in the longitudinal direction of the drum shaft. In some examples, The third projecting lifting surface and the third fixed lifting surface can be positioned at the center of the length of the drum body in the longitudinal direction of the drum shaft.

In some implementations, the lifter can extend in a wave fashion. The projecting surface can include a first projecting laundry-tossing surface, which extends so as to be convex in the main rotational direction, and a second projecting laundry-tossing surface, which extends so as to be convex in the direction opposite the main rotational direction. In some examples, the fixed surface can include a first fixed laundry-tossing surface, which extends so as to be convex in the main rotational direction, and a second fixed laundry-tossing surface, which extends so as to be convex in the direction opposite the main rotational direction.

DETAILED DESCRIPTION

One or more implementations of the present disclosure will be described with the accompanying drawings.

Figure 1:
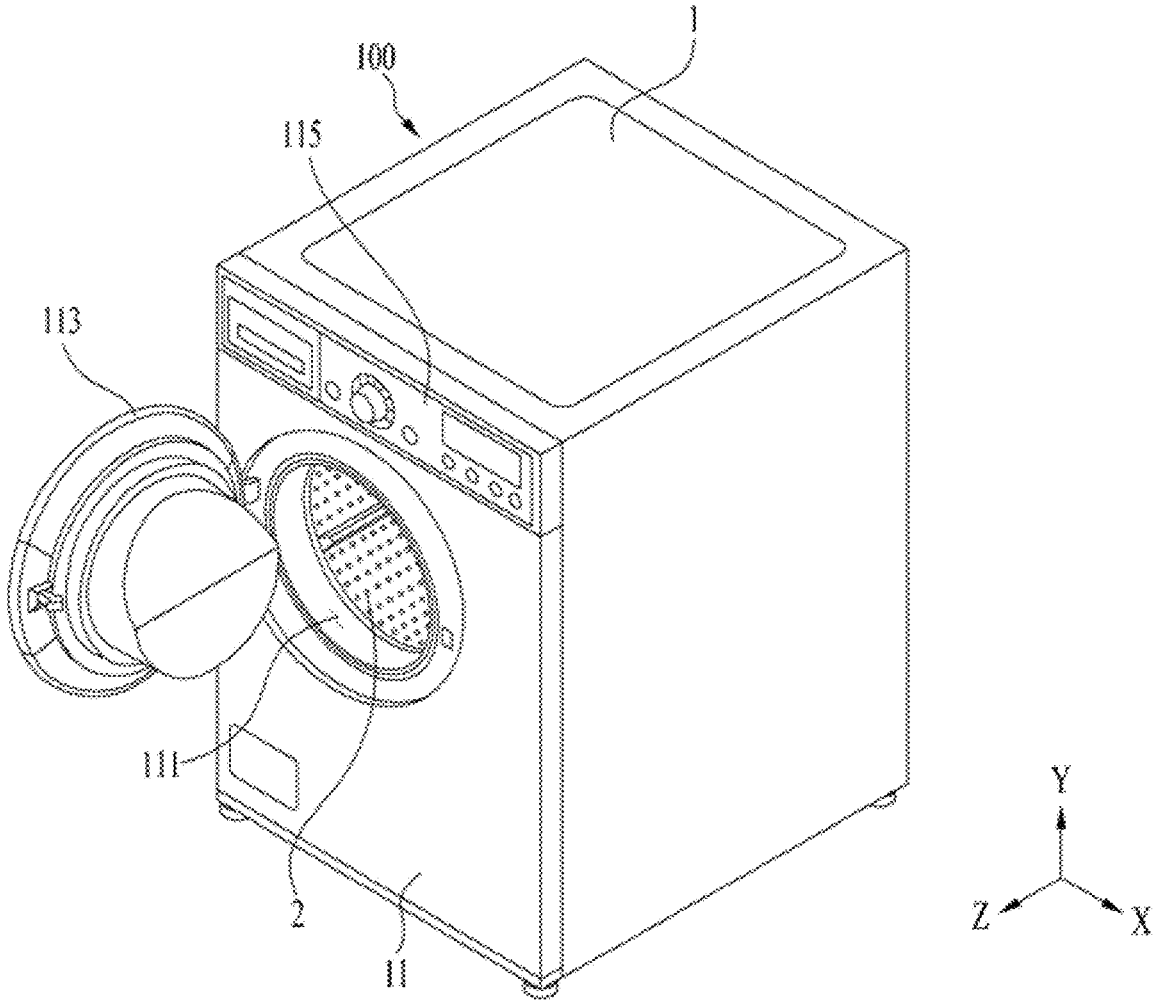
FIG. 1 illustrates an example of a laundry treatment apparatus.

FIG. 1 illustrates an example of a laundry treatment apparatus 100.

Figure 2:
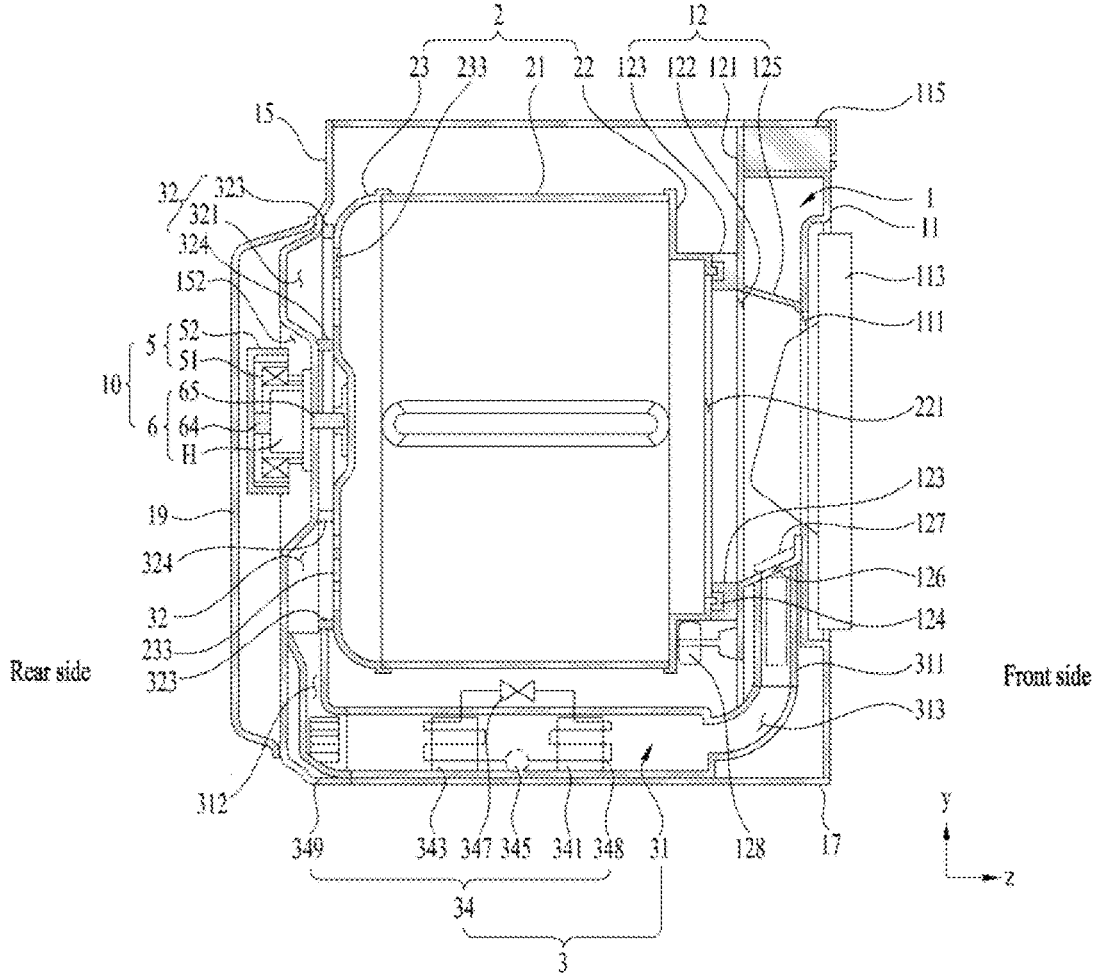
FIG. 2 illustrates a cross-section of the laundry treatment apparatus.

In some implementations, the laundry treatment apparatus 100 can include a cabinet 1 and a drum 2, which is rotatably provided in the cabinet 1 and defines a space for receiving laundry (an object to be washed or dried). As illustrated in FIG. 2, the cabinet 1 can be provided therein with a drying unit 3 configured to supply hot and dried air (air having a temperature higher than an ambient temperature and a dryness higher than the dryness of indoor air) to thus remove moisture from the laundry.

In some examples, referring to FIGS. 1 and 2, the cabinet 1 can include a front panel 11 defining the front surface of the laundry treatment apparatus 100 and a base panel 17 defining the bottom surface of the laundry treatment apparatus 100. The front panel 11 can be provided with an entrance 111 communicating with the drum 2. The entrance can be configured to be opened and closed by a door 113.

The front panel 11 can be provided with a control panel 115. The control panel 115 can include an input unit, into which control commands are input by a user, and a display unit configured to output information such as control commands, which are capable of being selected by the user. The input unit can include a power supply request unit configured to request supply of power to the laundry treatment apparatus 100, a course input unit configured to allow a user to select a desired course among a plurality of courses, and an execution request unit configured to request execution of the course that is selected by the user.

The drum 2 can be configured to have the form of a hollow cylinder. FIG. 2 illustrates an example in which the drum 2 is composed of a cylindrical drum body 21, which is open at the front and rear surfaces thereof, a front cover 22 defining the front surface of the drum body 21, and a rear cover 23 defining the rear surface of the drum body 21. The front cover 22 can include a drum entrance 221, through which the inside of the drum body 21 communicates with the outside, and the rear cover 23 can include an air introduction hole 233 (see FIG. 3), through which external air is introduced into the drum body 21.

Figure 7A:
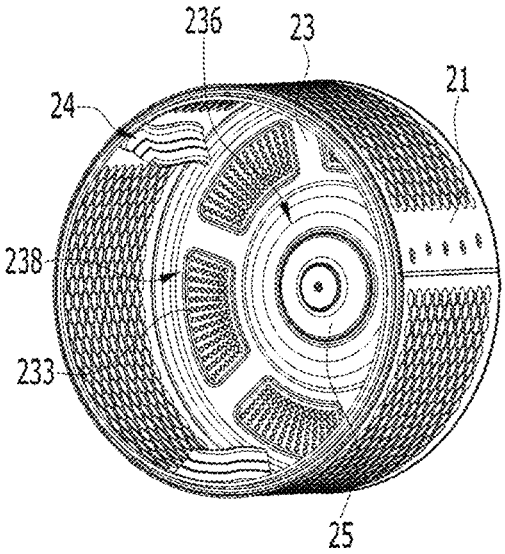
FIG. 7A illustrates an example of a drum and a protective cover.

The drum body 21 can further include a lifter 24 (see FIG. 7A). The lifter 24 can be configured such that a board, which extends toward the rear cover 23 from the front cover 22, projects toward the rotational center of the drum 2 from the drum body 21 (that is, toward the rotational center of the drum 2 from the circumferential surface of the drum 2).

When the laundry treatment apparatus 100 is designed to perform only drying of laundry, there is no need to provide drum through-holes, which are formed through the drum body 21 so as to allow the inside of the drum 2 to communicate with the outside.

The drum 2 can be rotatably held by at least one of a first support 12 or a second support 15. In this implementation, the rear cover 23 can be held by the second support 15 so as to be rotatable by a motor 5 (see FIG. 3), and the front cover 22 is rotatably connected to the first support 12.

The first support 12 can be composed of a support panel 121, which is fixed to the cabinet 1 and is positioned between the front panel 11 and the front cover 22. The support panel 121 can be fixed to the base panel 17, and can be positioned between the front panel 11 and the front cover 22. Here, the rear surface of the front panel 11 (the surface that faces the support panel 121) can be fixed to the support panel 121, and the lower end of the front panel 11 can be fixed to the base panel 17.

The support panel 121 can include a support panel through-hole 122, a drum connection body 123 (see FIG. 2) connecting the support panel through-hole 122 with the drum entrance 221, and a panel connection body 125 connecting the support panel through-hole 122 with the entrance 111. The support panel through-hole 122 can be formed through the support panel 121 so as to allow the entrance 111 to communicate with the drum entrance 221.

As illustrated in FIG. 2, the drum connection body 123 can be composed of a pipe fixed to the rear surface of the support panel 121 (the surface that faces the drum entrance). One end of the drum connection body 123 can be configured so as to surround the support panel through-hole 122, and the free end of the drum connection body 123 can be configured so as to support the front cover 22. In other words, the free end of the drum connection body 123 can be configured so as to be inserted into the drum entrance 221 or to be in contact with the free end of the front cover 22 defining the drum entrance 221.

FIG. 2 illustrates an example in which the free end of the drum connection body 123 is in contact with the free end of the front cover 22. Here, the drum connection body 123 can be provided with a ring-shaped connection damper 124. The connection damper 124 can serve to minimize the risk of the drum entrance 221 being separated from the drum connection body 123 (the risk of the air in the drum leaking into the cabinet) when the drum 2 rotates or vibrates.

The panel connection body 125 can be composed of a pipe fixed to the front surface of the support panel 121 (the surface that faces the front panel). One end of the panel connection body 125 can be configured so as to surround the support panel through-hole 122, and the other end of the panel connection body 125 can be configured so as to be connected to the entrance 111. Consequently, the laundry supplied to the entrance 111 can be transferred to the drum body 21 through the panel connection body 125, the support panel thorough-hole 122, the drum connection body 123, and the drum entrance 221.

The support panel 121 can include an exhaust port 126, which is formed through the panel connection body 125. A filter 127 can be detachably fixed to the exhaust port 126. The filter 127 can be configured to have any structure capable of filtering contaminants from the air that flows to the exhaust port 126 from the drum 2.

Figure 3:
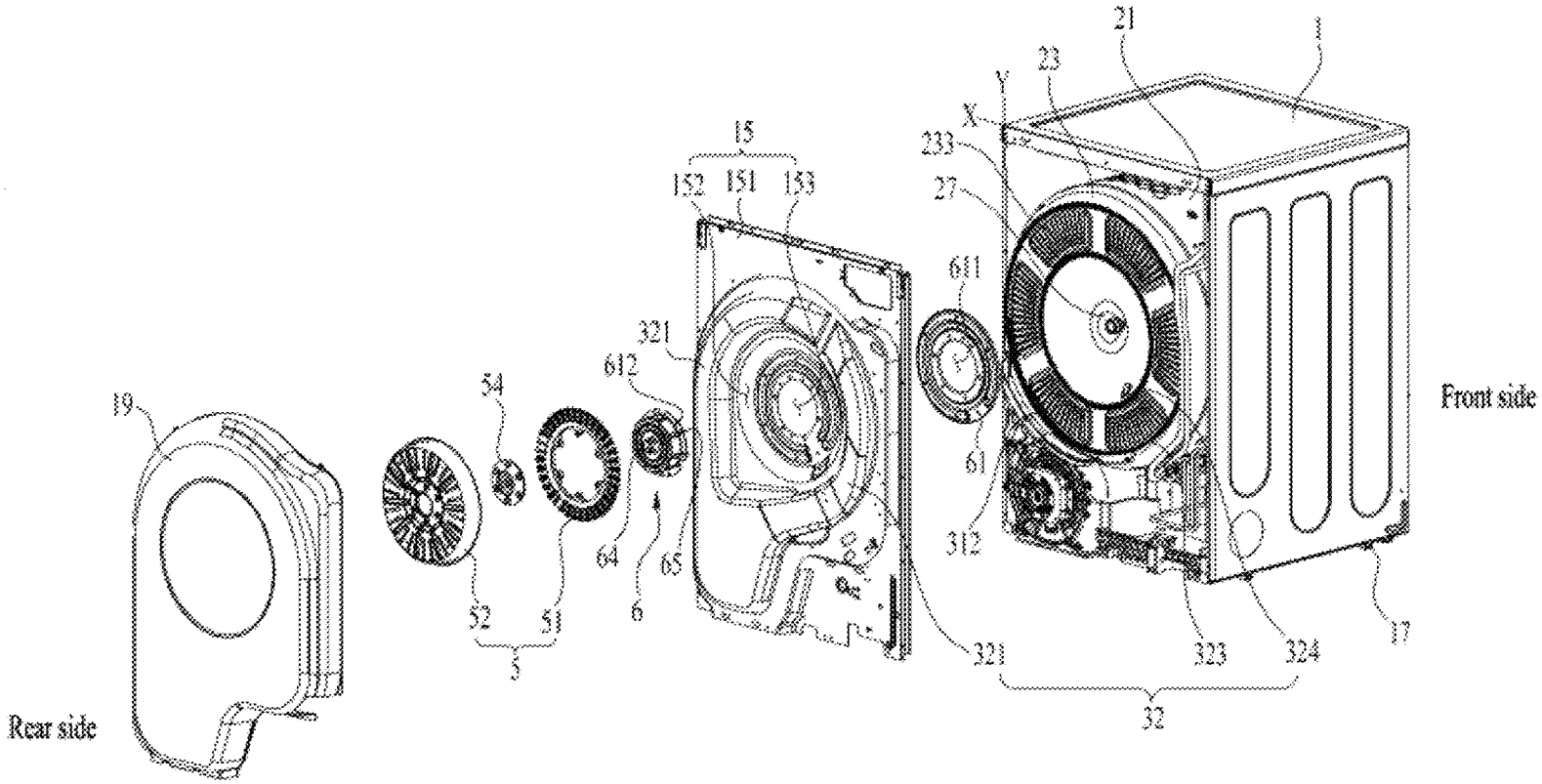
FIG. 3 illustrates an example of the internal structure of the laundry treatment apparatus.

The support panel 121 can further include a drum support 128 configured to prevent the drum 2 from drooping. The drum support 128 can include a first roller, which is fixed to the support panel 121 so as to rotatably support the drum 2, and a second roller. In some examples, as illustrated in FIG. 3, the first roller can support the drum body 21. In some examples, the rollers can support the front cover 22.

The second support 15 can be composed of a fixed panel 151, which is fixed to the cabinet 1 so as to be spaced apart from the rear cover 23. FIG. 3 illustrates an example in which the fixed panel 151 is fixed to the base panel 17 so as to define the rear surface of the laundry treatment apparatus 100 (i.e. the rear surface of the cabinet 1).

The fixed panel 151 can include a motor-mounting recess 152, which defines a space in which the motor 5 is mounted. The motor-mounting recess 152 can be composed of a groove depressed toward the rear cover 23 of the drum 2 from the fixed panel 151. The fixed panel 151 can include a fixed panel through-hole 153 through which a shaft configured to rotate the drum 2 extends. The fixed panel through-hole 153 can be positioned in the motor-mounting recess 152.

As described above, when the drum 2 is composed of the drum body 21, the front cover 22 fixed to the drum body 21, and the rear cover 23 fixed to the drum body 21, the rigidity of the drum 2 is increased, compared to a structure in which the front surface and the rear surface of the drum body 21, which are open, are respectively and rotatably connected to the support panel 121 and the fixed panel 151. The increased rigidity of the drum 2 enables minimization of deformation of the drum body 21 during rotation of the drum 2, thereby minimizing a problem in which laundry is jammed between the drum body 21 and the fixed panel 151 (i.e. thereby enabling minimization of the load on the motor).

As illustrated in FIG. 2, the drying unit can include an exhaust passage 31 connected to the exhaust port 126, a supply passage 32 configured to guide the air in the exhaust passage 31 toward the drum body 21, and a heat-exchanging unit 34, which is disposed in the exhaust passage 31 so as to sequentially perform dehumidification and heating of the air.

The exhaust passage 31 can include a first duct 311 connected to the exhaust port 126, a second duct 312 connected to the supply passage 32, and a third duct 313 connecting the first duct to the second duct 312. The third duct 313 can be fixed to the base panel 17.

The heat-exchanging unit 34 can be implemented as any device capable of sequentially performing dehumidification and heating of the air that is introduced into the exhaust passage 31. FIG. 2 illustrates an example in which the heat-exchanging unit 34 is implemented as a heat pump. Specifically, the heat-exchanging unit 34 can include a first heat exchanger (a heat adsorption part) 341 configured to remove moisture from the air introduced into the exhaust passage 31, a second heat exchanger (a heat radiation part) 343 configured to heat the air that has passed through the heat adsorption part 341, and a fan 349 configured to cause the air discharged from the drum 2 to sequentially pass through the heat adsorption part and the heat radiation part and then to be transferred to the supply passage 32.

The heat adsorption part 341 and the heat radiation part 342 can be sequentially disposed in the direction in which air currents, and can be connected to each other via a refrigerant pipe 348 constituting a refrigerant circulation passage. Refrigerant can be transferred along the refrigerant pipe 348 by means of a compressor 345, which is positioned outside the exhaust passage 31, and the refrigerant pipe 348 can be provided with a pressure regulator 347 configured to regulate the pressure of the refrigerant.

As illustrated in FIG. 3, an air introduction hole 233 formed in the rear cover 23 of the drum 2 can be implemented as a plurality of holes which are arranged so as to surround the center of the rear cover 23 (i.e., the rotational center of the drum 2). Here, the supply passage 32 can include a supply duct 321, which is provided at the fixed panel 151 so as to define a transfer path for the air discharged from the second duct 312, and a first passage-defining portion 323 and a second passage-defining portion 324, which serve to guide the air in the supply duct 321 toward the air introduction hole 233.

The supply duct 321 can be formed in such a manner that the fixed panel 151 is bent in a direction away from the rear cover 23 so as to define a passage (an air transfer passage). Furthermore, the supply duct 321 can be configured so as to have a ring form surrounding the motor-mounting recess 152, and the second duct 312 can be connected to the circumferential surface of the supply duct 321.

The first passage-defining portion 323 can be configured so as to surround the outer circumferential surface of the ring constituted by the air introduction hole 233, and the second passage-defining portion 324 can be configured so as to surround the inner circumferential surface of the ring constituted by the air introduction hole 233.

The first passage-defining portion 323 and the second passage-defining portion 324 can be fixed to the rear cover 23, and can also be fixed to the supply duct 321. FIG. 3 illustrates an example in which the first and second passage-defining portions 323 and 324 are fixed to the rear cover 23. In FIG. 3, the free end of the first passage-defining portion 323 can surround the outer circumferential surface of the passage (the ring-shaped passage) defined by the supply duct 321, and the free end of the second passage-defining portion 324 can surround the inner circumferential surface of the passage defined by the supply duct 321. The first passage-defining portion 323 and the second passage-defining portion 324 can be made of rubber or felt.

The motor 5, configured to rotate the drum 2 can include a stator 51, which is positioned in the motor-mounting recess 152 so as to generate a rotating field, and a rotor 52, which is rotated due to rotation of the rotating field. The rotational movement of the rotor 52 is transmitted to the drum 2 via a power transmission unit 6 fixed to the fixed panel 151, and the stator 51 can be fixed to one of the fixed panel 151 and the power transmission unit 6. When the stator 51 is fixed to the power transmission unit 6, there is an advantage in maintenance of coaxiality between a rotor shaft 64 and a drum shaft 65, which are provided at the power transmission unit 6 (it is possible to minimize vibration of the laundry treatment apparatus and deterioration of the durability of the power transmission unit 6).

In order to prevent the motor 5 provided in the motor-mounting recess 512 from being exposed to the outside (to thus improve the durability of the motor and to prevent the occurrence of an accident), the fixed panel 151 can be further provided with a cover panel 19 configured to prevent the motor 5 from being exposed to the outside. In addition, the cover panel 19 can be configured to have a shape capable of preventing the supply duct 321 from being exposed to the outside (a shape surrounding the supply duct 321). The reason for this is not only to minimize leakage of heat to the outside of the supply duct 321 but also to prevent an accident that can occur when a human body comes into contact with the supply duct 321.

The laundry treatment apparatus 100 can include a drive unit 10 configured to rotate the drum 20. The drive unit 10 can include the motor 5 configured to generate rotational force, and the power transmission unit 6 configured to transmit the rotational force to the drum 2. In other words, the rotor shaft 64 of the motor 5, which is rotated due to the rotation of the rotating field, can be connected to the power transmission unit 6 rather being directly connected to the drum 2, as illustrated in FIG. 3. The power transmission unit 6 can be connected to the drum 2 via the additional drum shaft 65. The reason for this is to lower the rotational speed of the motor 5 via the power transmission unit 6 and to increase the torque of the motor 5.

Specifically, the drive unit 10 can include the stator 51, configured to generate a rotating field, and the power transmission unit 6 composed of the motor 5 including the rotor, which is rotated due to the rotation of the rotating field, the rotor shaft 64, which is positioned between the rear cover 23 and the motor 5 and which is fixed at one end thereof to the rotor 52 so as to be rotated therewith, the drum shaft 65, which is coupled at one end thereof to a shaft bracket 27 so as to rotate the drum 2, and a gear unit G configured to transmit the rotational movement of the rotor shaft 64 to the drum shaft 65.

Figure 4:
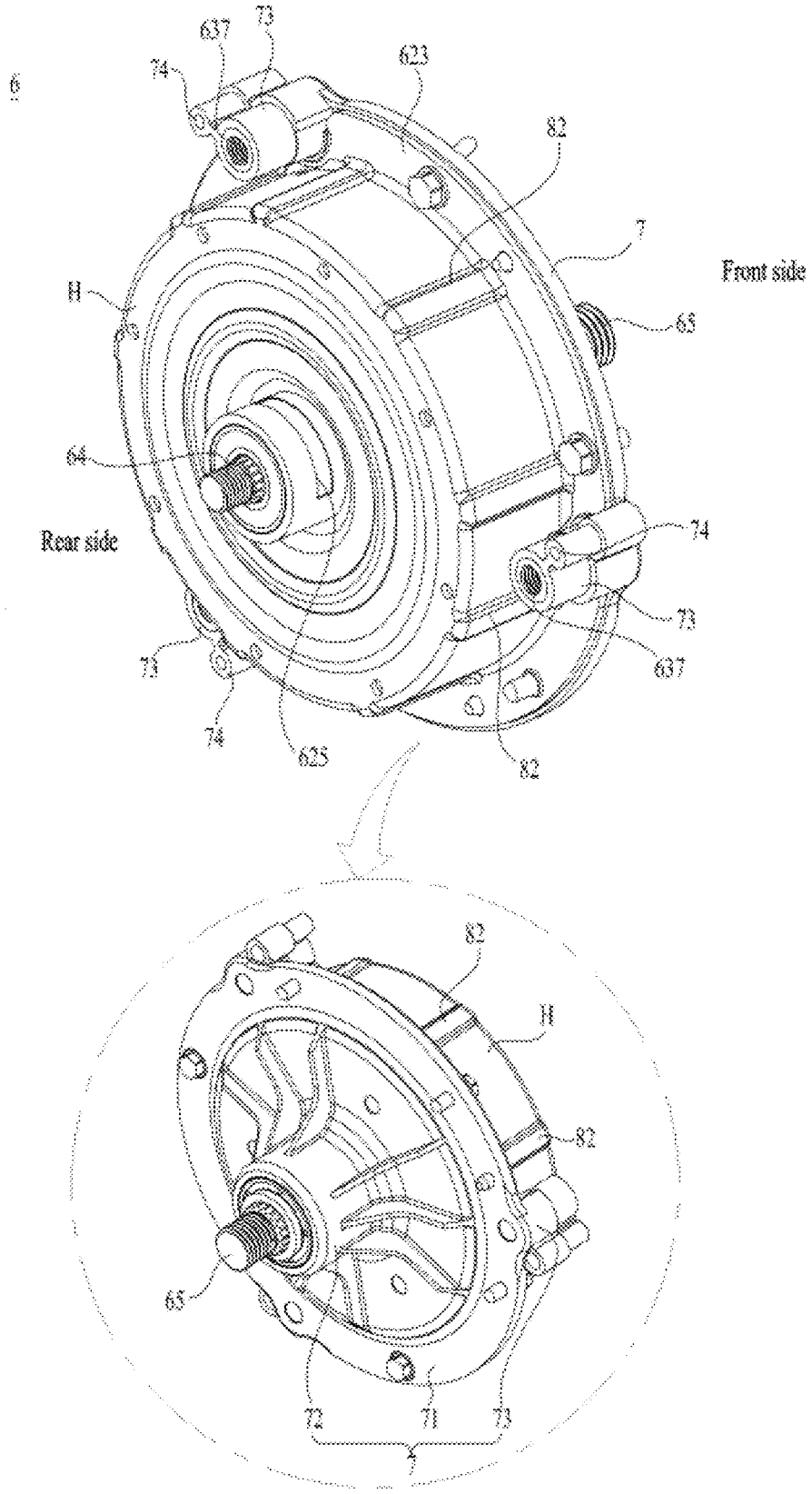
FIG. 4 illustrates an example of a power transmission unit.
Figure 5:
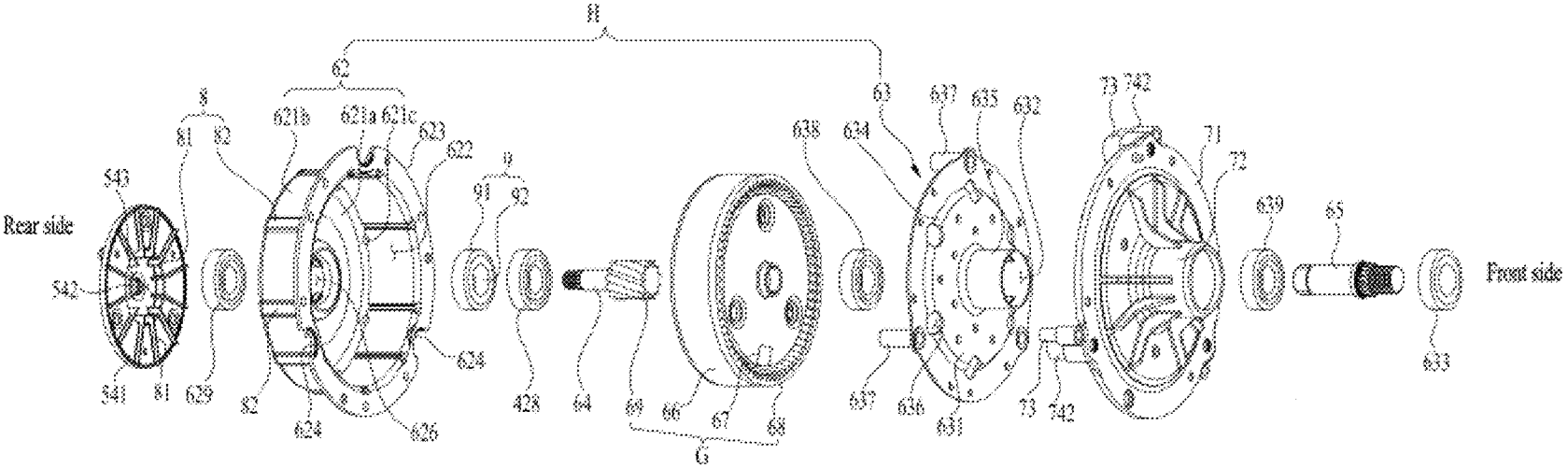
FIG. 5 is an exploded view showing the power transmission unit

FIGS. 4 and 5 illustrate an example of the power transmission unit 6. The power transmission unit 6 can include a housing H (see FIG. 5) fixed to the fixed panel 151, the rotor shaft 64 rotatably fixed to the bottom surface of the housing H (the surface of the housing H that faces the rotor), the drum shaft 65 rotatably fixed to the upper surface of the housing H (the surface of the housing H that faces the fixed panel), and the gear unit G (see FIG. 5), which is provided in the housing H so as to transmit the rotational movement of the rotor shaft 64 to the drum shaft 65. The rotor shaft 64 can be implemented as a shaft, which is fixed at one end thereof to the rotor 52 and is positioned at the other end thereof in the housing H, and the drum shaft 65 can be implemented as a shaft, which is fixed at one end thereof to the rear cover 23 and is positioned at the other end thereof in the housing H.

The housing H can be fixed to the fixed panel 151, and can be positioned in a space (the external space of the cabinet) isolated from the space in which the drum 2 is disposed. The reason for this is to improve the durability of the power transmission unit 6 by minimizing transmission of the heat in the cabinet (the heat generated from the drum or the drying unit) to the inside of the housing H.

The rotor shaft 64 can be coupled to the rotor 52 via the shaft coupler 54 shown in FIG. 3. The shaft coupler 54 can include a disc-shaped coupling body and a shaft-coupling hole, which is formed through the coupling body and is coupled to one end of the rotor shaft 64.

The drum shaft 65 can be inserted into the fixed panel through-hole 153, and can be coupled to the drum 2. The rear cover 23 can be provided with the shaft bracket 27 (see FIG. 3) to which the drum shaft 65 is fixed. The reason for this is to distribute the stress applied to the center of the rear cover 23 during rotation of the drum shaft 65.

In order to prevent drooping of the housing H and to minimize deformation of the motor-mounting recess 152, the housing H can be fixed to the fixed panel 151 via a transmitting bracket 61 and a housing coupler 612.

As illustrated in FIG. 3, the transmitting bracket 61 can have a bracket through-hole 611 through which the drum shaft 65 extends, and the housing coupler 612 can be implemented as a bolt connecting the housing H to the transmitting bracket 61. The transmitting bracket 61 can be made of the same material as the fixed panel 151, and can be made of a material having a strength higher than that of the fixed panel 151.

In some examples, as shown in FIG. 3, the transmitting bracket 61 can be fixed to the surface of the fixed panel 151 that faces the rear cover 23. In some examples, the transmitting bracket 61 can be fixed to the surface of the fixed panel 151 that faces the cover panel 19.

As illustrated in FIG. 5, the housing H can include a housing body 62, which is configured to have a hollow cylindrical form with an opening hole formed in the surface thereof that faces the fixed panel 151, and a housing cover 63, which is fixed to the housing body 62 and closes the opening hole.

The housing body 62 can have a reception space 622 in which the gear unit G is mounted. The reception space 622 can communicate with the outside via the opening hole. The reception space 622 can include a housing base 621*a* to which the rotor shaft 64 is fixed, and a housing circumferential wall 621*b*, which extends toward the housing cover 63 from the periphery of the housing base 621*a*.

As illustrated in FIG. 5, the housing body 62 can include a rotor shaft support 625, which extends toward the rotor 52 from the housing base 621*a*. The rotor shaft support 625 can be implemented as a pipe surrounding a rotor shaft through-hole 626 formed through the housing body 62. In other words, the rotor shaft through-hole 626 can be formed through the rotor shaft support 625 so as to communicate with the reception space 622.

The rotor shaft 64, which is inserted into the rotor shaft through-hole 626, can be rotatably supported by the rotor shaft support 625 via rotor shaft bearings 628 and 629. The rotor shaft bearings can include a first rotor shaft bearing 628 and a second rotor shaft bearing 629, which is fixed in the rotor shaft through-hole 626 so as to be positioned between the first rotor shaft bearing 628 and the rotor 52.

The free end of the rotor shaft support 625 can be inserted into a coupling body bent portion 542 formed at the shaft coupler 54. The length of the rotor shaft support 625 must be increased in order to hold the two rotor shaft bearings 628 and 629. Accordingly, when the free end of the rotor shaft support 625 is inserted into the coupling body bent portion 542, there is an effect of minimizing the amount of space to mount the motor 5 and the power transmission unit 6 (the volume of the laundry treatment apparatus).

The housing cover 63 can be configured to have any form capable of opening and closing the opening hole formed in the housing body 62. FIG. 5 illustrates an example in which the housing cover 63 includes a disc-shaped cover body 631. The housing cover 63 can be fixed to the housing body 62 via a cover-fixing plate 623 provided on the housing circumferential wall 621*b*.

The housing cover 63 can include a drum shaft support 635, which extends toward the fixed panel 151 from the cover body 631, a drum shaft through-hole 632, which is formed through the drum shaft support 635 and into which the drum shaft 65 is inserted, and drum shaft bearings 638 and 639, which are provided at the drum shaft support 635 so as to rotatably hold the drum shaft 65 in the drum shaft through-hole 632.

The housing cover 63 can include a mounting portion 637, which is provided at the cover body 631 and to which the stator 51 is fixed. The mounting portion 637 can be configured to have any form capable of being coupled to a stator coupler (for example, a bolt or the like). For example, the drawing illustrates an example in which the mounting portion 637 is configured to have a hollow cylindrical form.

The mounting portion 637 can include a plurality of mounting portions, which are arranged along the circumferential surface of the cover body 631, and the stator bracket 515 can include the same number of stator brackets as the mounting portion 637.

When the mounting portion 637 is configured to have a cylindrical form that projects toward the rotor 52 from the cover body 631, the cover-fixing plate 623 can have a fixing plate through-hole 624 into which the mounting portion 637 is inserted. The reason for this is to minimize the outside diameter of the cover-fixing plate 623 (i.e., to minimize the amount of space to mount the housing).

In order to increase the strength of the housing cover 63, the cover body 631 can include a bent portion 634, which is formed by a region including the drum shaft through-hole 632 projecting toward the fixed panel 151.

The drum shaft bearings can include a first drum shaft bearing 638 and a second drum shaft bearing 639, which are fixed to the drum shaft support 635 and are positioned in the drum shaft through-hole 632. In order to prevent external air from being supplied to the drum shaft bearings 638 and 639, the housing cover 63 can further include a seal 633, which is fixed to the drum shaft support 635 so as to close the drum shaft through-hole 632.

Figure 6:
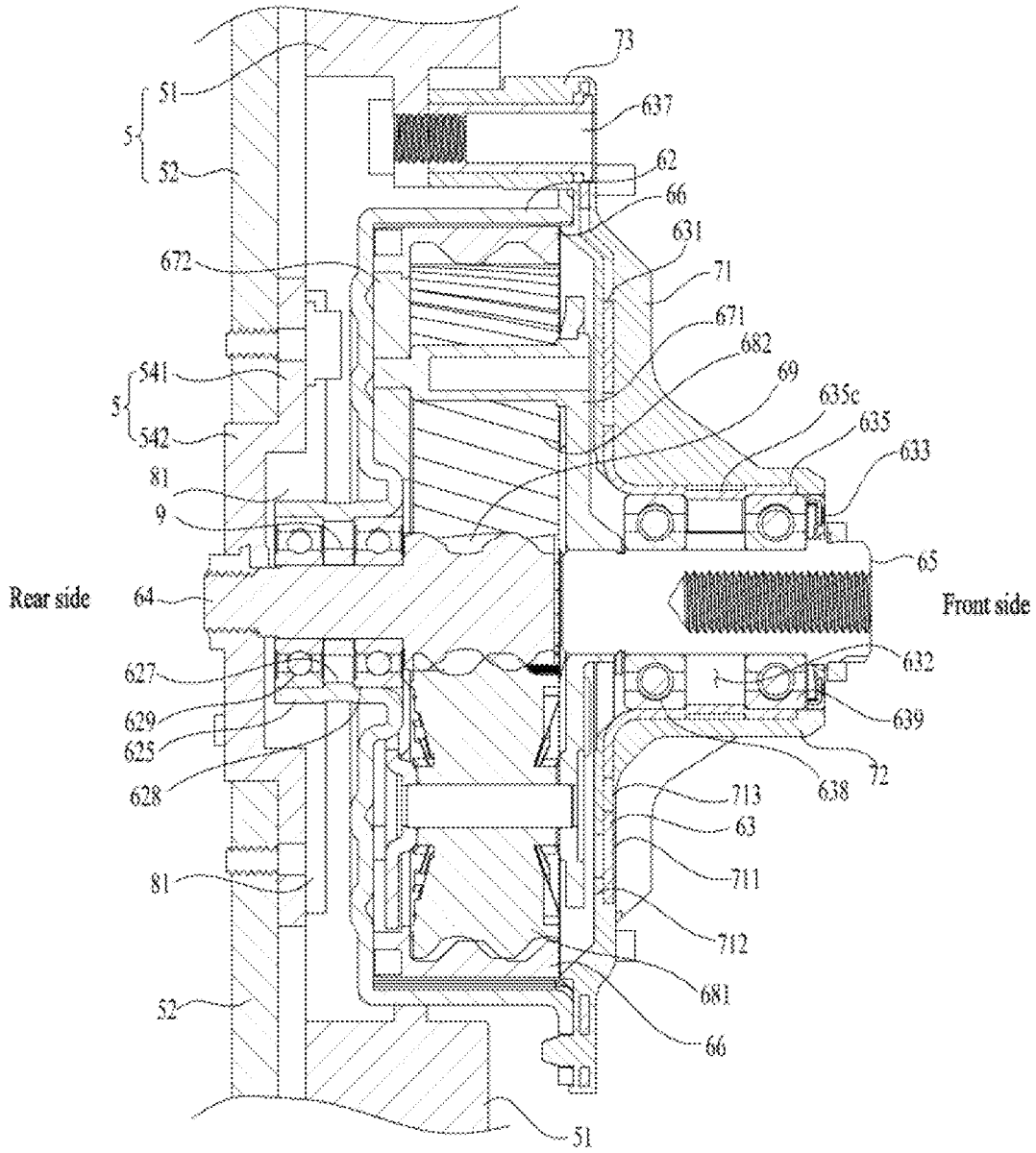
FIG. 6 illustrates a cross-section of the power transmission unit.

The housing H can be fixed to the fixed panel 151 via the housing coupler 612, and the stator 51 can be fixed to the housing H by inserting the stator coupler into a coupler through-hole 516 and fixing the same to the mounting portion 637. The rotor 52 can be fixed to the housing H via the rotor shaft 64. In other words, because the stator 51 and the rotor 52 are fixed to the housing H (i.e., because the stator 51 and the rotor 52 vibrate together with the housing H), it is possible to minimize deterioration of coaxiality between the rotor shaft and the drum shaft 65. The gear unit G can include a ring gear 66, which is fixed to the housing circumferential wall 621*b* and is positioned in the reception space 622, a drive gear 69, which is fixed to the rotor shaft 64 and is positioned in the reception space 622, a cage 67, which is positioned in the reception space and to which the other end of the drum shaft 65 is fixed, and a driven gear 98, which is rotatably fixed to the cage 67 so as to connect the drive gear 69 to the ring gear 66. As illustrated in FIG. 6, in order to minimize the risk of separation of the rotor shaft bearings 628 and 629 or the rotor shaft support 625 due to application of external force to the rotor shaft 64, the laundry treatment apparatus 100 can include a damper 9.

The damper 9 can be provided in the rotor shaft through-hole 626 so as to be positioned between the first rotor shaft bearing 628 and the second rotor shaft bearing 629, in order to attenuate vibrations of the first rotor shaft bearing 628 transmitted to the second rotor shaft bearing 629.

The damper 9 can be implemented as an elastic body (for example, rubber or the like), which is fixed to the circumferential surface of the rotor shaft 64 and is positioned between the first rotor shaft bearing 628 and the second rotor shaft bearing 629. As illustrated in FIG. 5, the damper 9 can include a damping body 91 having a diameter larger than the diameter of the rotor shaft 64 but smaller than the diameter of the rotor shaft through-hole 626 (i.e., a damping body having a diameter smaller than the outside diameter of the rotor shaft bearing), and a damping body through-hole 92, which is formed through the damping body 91 and into which the rotor shaft 64 is inserted.

As illustrated in FIG. 6, in order to minimize vibration of the housing H, one end of the damping body 91 can be in contact with the first rotor shaft bearing 628, and the other end of the damping body 91 can be in contact with the second rotor shaft bearing 629.

The rotor shaft support 625 can further include a stopper (first stopper) 627, which projects from the center of the rotor shaft through-hole 626 and is positioned between the first rotor shaft bearing 628 and the second rotor shaft bearing 629. The first stopper 627 can serve as means for limiting the range within which the first rotor shaft bearing 628 moves toward the second rotor shaft bearing 629 or the range within which the second rotor shaft bearing 629 moves toward the first rotor shaft bearing 628.

Because the damping body 91 is coupled to the circumferential surface of the rotor shaft 64 (because the damping body 91 is rotated together with the rotor shaft 64), the radius of the damping body 91 (the outside radius of the damper) can be set to be less than the distance between the center of the rotor shaft through-hole 626 and the first stopper 627.

In order to minimize the risk of the drum shaft bearings 638 and 639 being separated from the housing H due to application of external force to the drum shaft 65, the drum shaft support 635 can include a stopper (a second stopper) 635*c* for limiting the range within which the first drum shaft bearing 638 and the second drum shaft bearing 639 move.

In order to minimize the amount of heat that is transmitted to the inside of the housing H and to radiate heat of the housing H to the outside, the laundry treatment apparatus can further include a radiating unit 8. As illustrated in FIG. 5, the radiating unit 8 can include at least one of a first radiator 81, which is disposed at the coupling body 541 so as to discharge the air between the housing body 62 and the rotor 52 to the outside of the rotor 52, or a second radiator 82, which is disposed on the housing circumferential wall 621*b* of the housing body 62 so as to radiate the heat in the reception space 622 to the outside of the reception space 622.

The first radiator 81 can be implemented as a blade projecting toward the housing base 621*a* from the coupling body 541. Because the coupling body 541 and the first radiator 81 are rotated when the rotor 52 rotates, the air between the rotor 52 and the housing body 62 is discharged to the outside of the rotor 52 through the rotor through-hole 531 while the temperature of the housing H is lowered.

In some examples, as illustrated in FIG. 5, the first radiator 81 can include a plurality of blades, which are radially arranged about a shaft-coupling hole 543. In some examples, the first radiator 8 can include a single blade provided at the coupling body 541.

When the coupling body 541 includes the coupling body bent portion 542, the first radiator 81 can be implemented as a blade, which extends to the periphery of the coupling body 541 from the coupling body bent portion 542. Consequently, because the height of the blade (the length of the blade in a direction toward the housing body from the coupling body) increases, there is an effect of increasing the amount of air that is discharged.

The second radiator 82 can be implemented as at least one of a housing projection projecting from the housing circumferential wall 621*b* (for example, a cooling fin or the like) or a housing bent portion, which is bent toward the reception space 622 from the housing circumferential wall 621*b* (for example, a bent groove or the like). Because the second radiator 82 increases the surface area of the housing circumferential wall 621*b*, it is possible to enable the housing body 62 to easily exchange heat with external air.

FIG. 7A illustrates an example of the drum 2 provided in the laundry treatment apparatus 100. Referring to FIG. 7A, the drum 2 can include the cylindrical drum body 21 and the rear cover 23 defining the rear surface of the drum body 21. The drum body 21 can include the lifter 24. The lifter 24 can be implemented as a board, which extends toward the rear cover 23 from the front cover 22 and projects toward the rotational center of the drum 2 from the drum body 21 (i.e., which projects toward the rotational center from the circumferential surface of the drum 2).

In some implementations, the inner circumferential surface of the drum body 21 can be embossed. Specifically, the inner circumferential surface of the drum body 21 can have curved recesses, which are depressed toward the outer circumferential surface of the drum body 21 and are repeatedly arranged at regular intervals. The depressed recesses can include first-type recesses each having a larger radius and second-type recesses each having a smaller radius. Each of the second-type recesses can be positioned between adjacent first-type recesses.

In some examples, the lifter 24 can have the form of a flat plate. In some examples, the lifter 24 can have the form of a curved plate having a corrugated surface. Specifically, the lifter 24 can be curved so as to become concave moving toward the rear end from the front end of the drum 2 and then to become convex from an inflection point. The reason for this is to move laundry rearwards rather than forwards in order to efficiently dry the laundry using hot air introduced from the air introduction hole 233 in the rear cover 23.

The lifter 24 can include at least one lifter provided on the inner circumferential surface of the drum body 21.

The air introduction hole 233, which is provided at the rear cover 23 of the drum 2, can be implemented as a plurality of holes, which are arranged so as to surround the center of the rear cover 23 (i.e., the rotational center of the drum 2). As described above, the supply passage 32 can include the supply duct 321, which is provided at the fixed panel 151 so as to define the transfer passage for the air discharged from the second duct 312, and the first passage-defining portion 323 and the second passage-defining portion 324, which are configured to guide the air in the supply duct 321 to the air introduction hole 233.

The drum 2 can include a protective cover 25 configured to prevent the shaft bracket 27 and the drum shaft 65 from being exposed to a laundry reception space from the center of the rear cover 23.

Figure 7B:
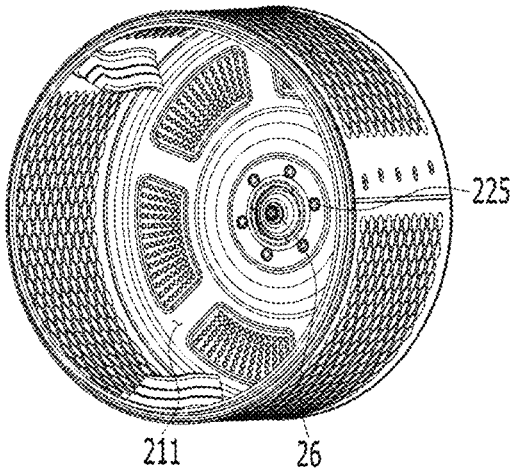
FIG. 7B illustrates an example of a shaft bracket and an example of a coupling nut with the protective cover being removed.

FIG. 7B illustrates a portion of the shaft bracket 27, the drum shaft 65, a rotating-shaft-coupling member 26, and a bracket-coupling member 225, which are exposed when the protective cover 25 is removed.

The laundry treatment apparatus can include the drum 2, which includes the cylindrical drum body 21 and the rear cover 23 defining the rear surface of the drum body 21 and receives laundry therein, the drive unit 10 including the drum shaft configured to rotate the drum 2, a rear cover through-hole 231 formed through the rear cover 23 in the axial direction of the drum shaft 65, the shaft bracket 27 coupled to the drum shaft 65 so as to close the rear cover through-hole 231, and the protective cover 25, which is positioned at the rear cover 23 so as to prevent the shaft bracket 27 and the drum shaft 65 from coming into contact with the laundry.

Accordingly, when the protective cover 25 is removed, the shaft bracket 27 and the drum shaft 65 can be exposed. In some examples, the shaft bracket 27 and the drum shaft 65 can be made of metal. In some cases, scratches and the like can be formed due to accessories or a zipper attached to laundry, and rust may be generated due to wet laundry. In order to prevent these problems, the protective cover 25 can be provided. The protective cover 25 can be made of plastic. The protective cover 25 can be configured to have the form of a dome in order to shield the shaft bracket 27 and the drum shaft 65. Specifically, the protective cover 25 can be depressed in an axial direction away from the rear cover 23. Consequently, the rear surface of the protective cover 25, that is, a protective cover rear surface 259 can cover a predetermined region around the center of the through-hole 231. The predetermined region, which is covered by the protective cover 25, can be the region of the rear cover 23 including the rear cover through-hole 231, which is shielded by the protective cover 25 and is thus not exposed to the outside.

FIG. 7A illustrates an example in which the predetermined region, which is covered by the protective cover 25, includes the bracket-coupling member 225 configured to couple the shaft bracket 27 to the rear cover 23. Unlike this, the protective cover 25 can expose the bracket-coupling member 225 and can shield the rear cover through-hole 231 and only a portion of the region around the rear cover through-hole 231, as illustrated in FIG. 9.

Figure 8C:
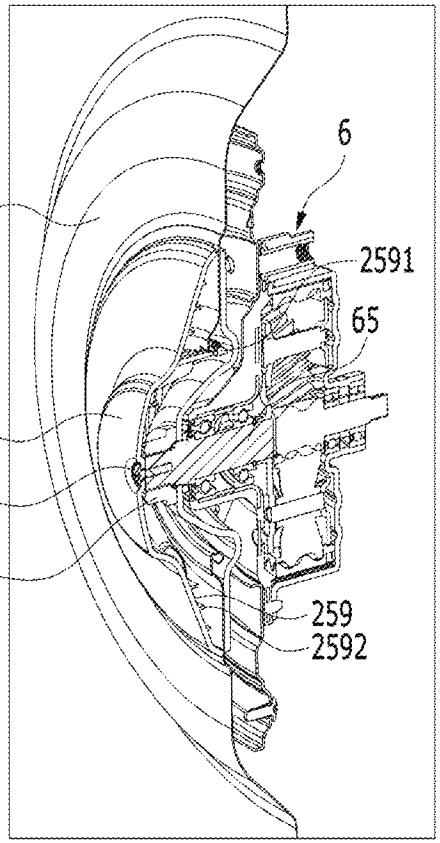
FIG. 8C illustrates an example of an assembly of the protective cover, the drum-drum shaft, the shaft bracket, and the rear cover.
Figure 8B:
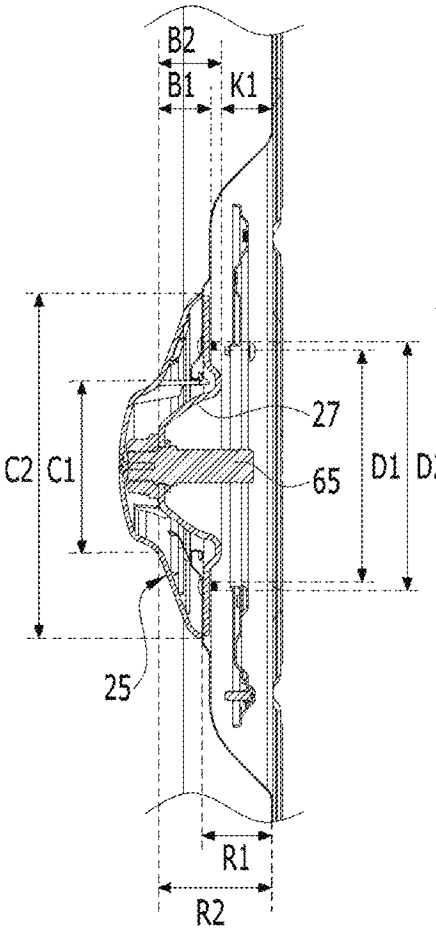
FIG. 8B illustrates a cross-section of an example of an assembly of the protective cover, the drum-drum shaft, the shaft bracket and the rear cover.
Figure 8A:
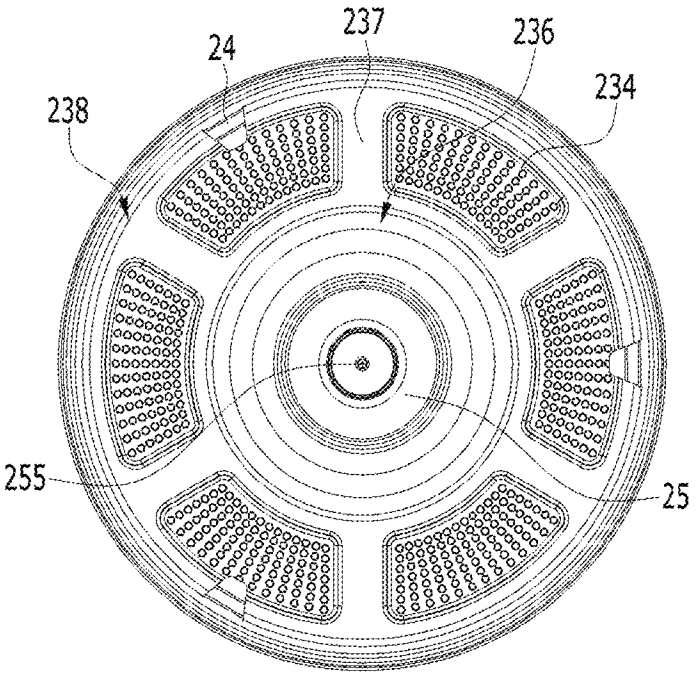
FIG. 8A illustrates an example of a rear cover of the drum when viewed from the front.

FIG. 8A illustrates an example of the rear cover 23. The rear cover 23 can include the rear cover through-hole 231 (see FIG. 9) formed in the center thereof, in which the shaft bracket 27 and the drum shaft 65 are inserted and coupled. The rear cover through-hole 231 can be formed through the rear cover 23 in the axial direction of the drum shaft 65. The drum shaft 65 must be connected to the drum 2 for rotation of the drum 2. Accordingly, the drum shaft 65 can be coupled to the shaft bracket 27 provided in the center of the rear cover 23, and the shaft bracket 27 can be fixed to the rear cover 23, thereby closing the rear cover through-hole 231.

Figure 9:
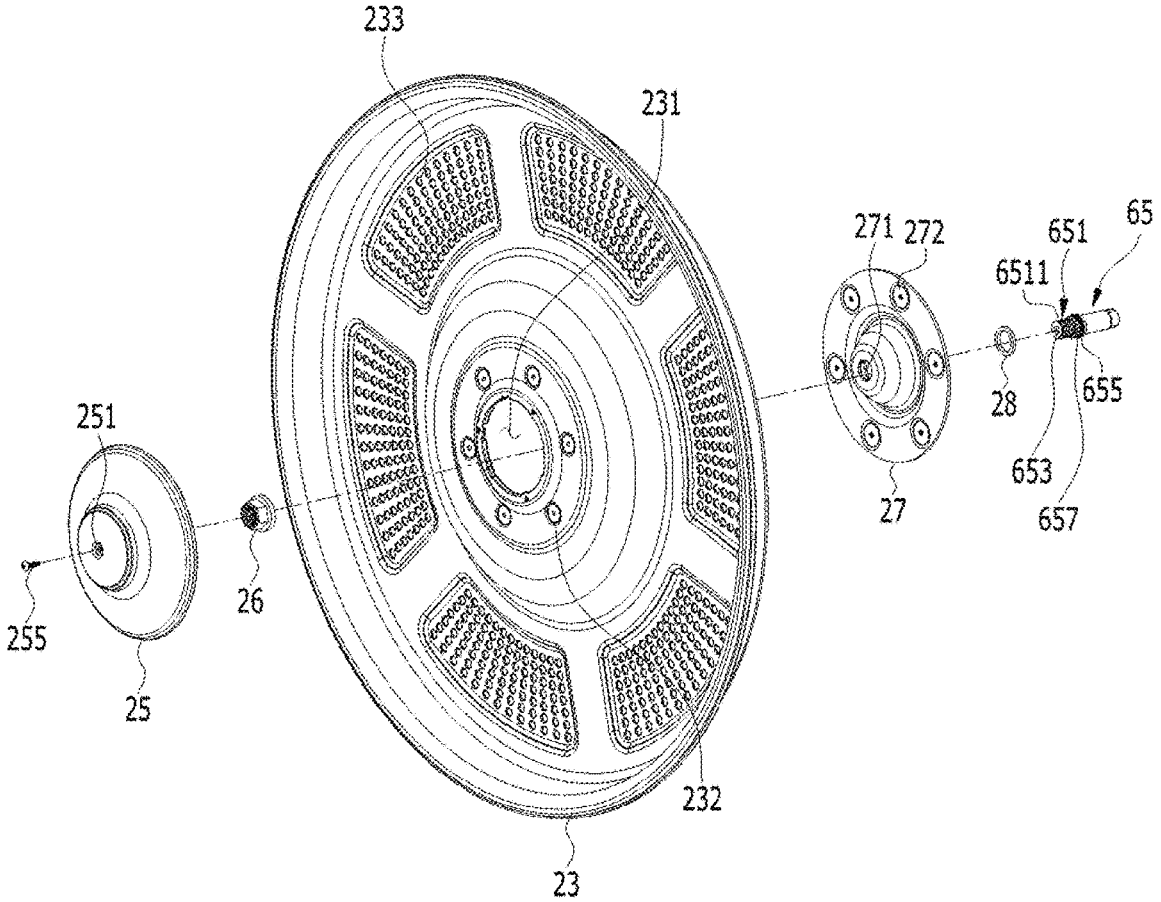
FIG. 9 is an exploded view showing the rear cover of the drum.

Referring to FIGS. 8A and 9, the protective cover 25 can be fixed to the drum shaft 65. The protective cover 25 can include a cover-coupling hole 251, which is formed through the center of the protective cover 25 in the axial direction. By virtue of the cover-coupling hole 251, the protective cover 25 and the drum shaft 65 can be coupled to each other by means of a protective-cover-fastening member 255.

The protective-cover-fastening member 255 can be a fastening member such as a screw. The portion of the protective cover 25 around the cover-coupling hole 251 can be depressed so as to correspond to the size of the protective-cover-fastening member 255 such that the head portion of the protective-cover-fastening member 255, that is, the head of the screw does not project from the protective cover 25. The reason for this is to prevent damage to laundry caused by the projecting head portion.

The thread of the protective-cover-fastening member 255 can be formed in a direction such that the drum shaft 65 and the protective cover 25 are more tightly fastened to each other when the protective-cover-fastening member 255 rotates in the same direction as the drum 2. The reason for this is to prevent the protective-cover-fastening member 255 from being loosened and separated from the drum shaft and to thus prevent the rear cover 23 from being separated from the protective cover 25 during rotation of the drum 2.

The drum shaft 65 is coupled to the rear cover 23 via the shaft bracket 27, and the rear cover 23 is coupled to the drum shaft 65. Accordingly, because the rear cover 23 and the protective cover 25 rotate at the same speed when the drum shaft 65 rotates, there is no slippage or friction due to the speed difference between the rear cover 23 and the protective cover 25.

Figure 11C:
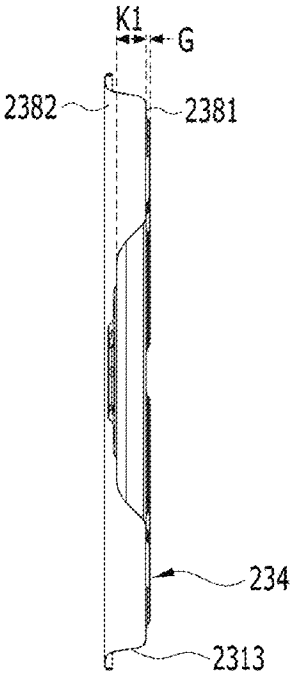
FIG. 11C is a cross-sectional view of the rear cover taken along line S-S' in FIG. 11B.
Figure 11B:
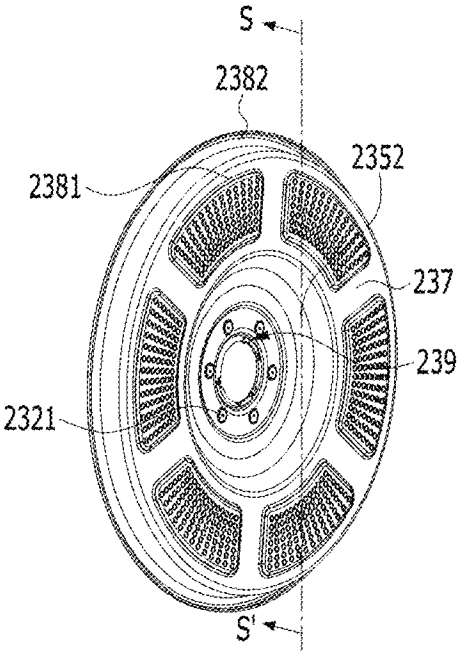
FIG. 11B illustrates the rear cover when viewed from the rear.
Figure 11A:
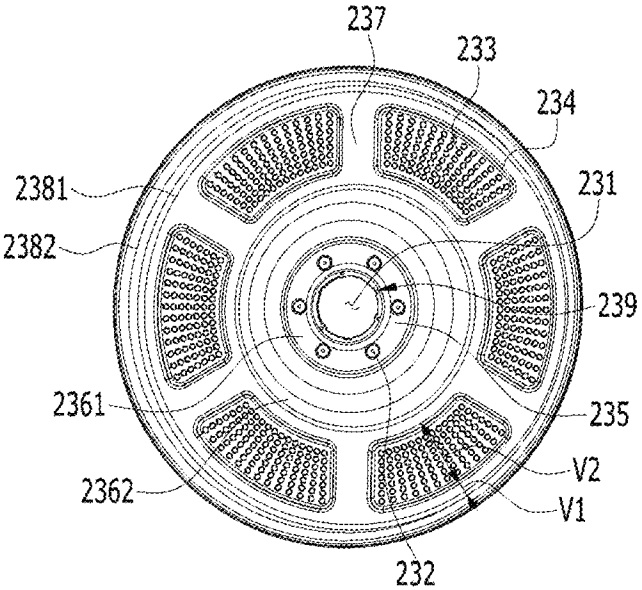
FIG. 11A illustrates the rear cover when viewed from the front.

Referring to FIG. 11A, the rear cover 23 can include the rear cover through-hole 231, which is formed in the center thereof and into which the shaft bracket 27 is inserted, a plurality of shaft-bracket-coupling holes 232 arranged around the rear cover through-hole 231 at regular intervals, and a shaft bracket coupler 235, which includes the rear cover through-hole 231 and the plurality of shaft-bracket-coupling holes 232 and bulges forwards to form a region to which the protective cover 25 is coupled.

The shaft bracket coupler 235 can project in the forward direction of the drum 2 further than the air introduction hole 233. The reason for this is to reduce the volume occupied by the drive unit 10 when the drive unit 10 is positioned behind the drum 2. Specifically, the drive unit, particularly, the drum shaft 65 of the power transmission unit can project forwards, and the projecting portion can be received in a drum shaft reception space 279, which is defined by the depressed portion of the shaft bracket coupler 235. Because the drum shaft 65 and the shaft bracket 27 are received in a rear surface recess 2311 (see FIG. 11B) formed in a rear coupling surface 2352 that is the rear surface of the rear cover 23, it is possible to reduce the overall size of the structure for coupling the drum 2 to the drive unit 10.

The rear cover 23 can include a plurality of rear-cover-reinforcing ribs 237, which extend radially from the shaft bracket coupler 235 like spokes and are connected to the periphery of the rear cover 23. The plurality of rear-cover-reinforcing ribs 237 are intended to increase the strength of the rear cover 23. A plurality of air introduction holes 233 can be formed through the rear cover 23 between respective ones of the plurality of rear-cover-reinforcing ribs 237.

Figure 10A:
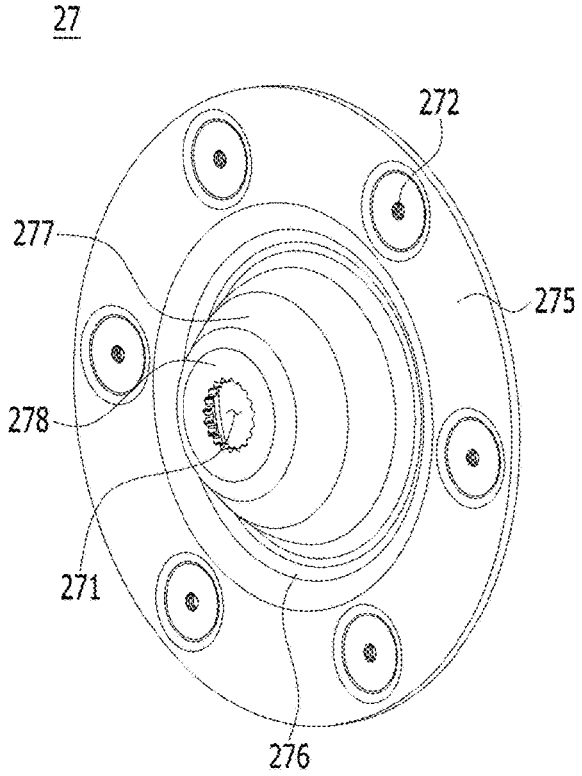
FIGS. 10A and 10B illustrate the shaft bracket when viewed from the front and the rear.

FIG. 10A illustrates an example of the shaft bracket 27, which is fixed to the rear cover 23 so as to close the rear cover through-hole 231. The shaft bracket 27 can be inserted into the rear cover through-hole 231, and can have a shaft-coupling hole 271, which is formed through the shaft bracket 27 so as to allow the drum shaft 65 to project into the drum 2. The shaft bracket 27 can be configured to project toward the rear cover 23. The shaft-coupling hole 271 can be positioned at the projecting portion of the shaft bracket 27.

FIG. 8B illustrates a cross-section of an assembly in which the rear cover 23, the shaft bracket 27, the drum shaft 65, and the protective cover 25 are coupled to one another. The drum shaft 65 can be coupled into the shaft-coupling hole 271. The drum shaft 65 can include a drum shaft flange 655 (see FIG. 9), which extends radially from the outer circumferential surface of the drum shaft 65, in order to prevent the drum shaft 65 from being inserted into the shaft-coupling hole 271 beyond a predetermined point when the drum shaft 65 is inserted into the shaft-coupling hole 271 beyond a predetermined distance. In other words, the drum shaft flange 655 can serve as a guide for assembly when the drum shaft 65 is inserted into the shaft bracket 27.

The shaft bracket 27 can be fixed to the rear cover 23. The shaft bracket 27 can be fixed to the shaft bracket coupler 235. As described above, in the case in which the shaft bracket is configured so as to project in the forward direction of the rear cover 23, the portion of the shaft bracket 27 that includes the shaft-coupling hole 271 can be inserted into the rear cover through-hole 231 and can project into the drum 2 when the shaft bracket 27 is fixed to the rear cover 23.

Accordingly, when the drum shaft 65 is coupled to the shaft bracket 27, a predetermined portion of the drum shaft 65 can project into the drum 2.

FIG. 8C illustrates a cross-section of a structure in which the drum shaft 65 of the power transmission unit 6 is inserted into the shaft-coupling hole 271 and projects therefrom and the shaft bracket 27 is inserted into the rear cover through-hole 231 and projects therefrom.

The protective cover 25 can have the cover-coupling hole 251, which is formed through the center thereof in the axial direction. The drum shaft 65 can have a cover-positioning hole 653 formed axially in the end of the drum shaft 65 that is inserted into the drum 2 so as to correspond to the cover-coupling hole 251. The protective-cover-fastening member 255 can be threaded into the cover-positioning hole 653 through the cover-coupling hole 251 so as to fix the protective cover 25 to the drum shaft 65.

The protective cover 25 can be connected to the drum shaft 65 in any manner other than the threading manner, as long as the protective cover 25 is capable of being coupled to the drum shaft 65 and rotated therewith. Because the reason why the protective cover 25 is coupled to the drum shaft 65 is to enable the protective cover 25 to rotate at the same speed as the drum 2, the protective cover 25 can also be coupled to the rear cover 23 rather than the drum shaft 65.

Referring to FIG. 8B, the outside diameter C1 of the protective cover 25 can be larger than the inside diameter C2 of the rear cover through-hole 231. Because the protective cover 25 is intended to prevent at least the shaft bracket 27 and the drum shaft 65 from being exposed, the protective cover 25 must have a size sufficient to cover the rear cover through-hole 231.

As described above, the rear cover 23 can have a plurality of shaft-bracket-coupling holes 232, which is formed around the rear cover through-hole 231 for coupling to the shaft bracket 27.

FIG. 8B illustrates an example in which the plurality of shaft-bracket-coupling holes 232 is an even number of shaft-bracket-coupling holes and each pair of shaft-bracket-coupling holes that diametrically face each other maintain the maximum distance D2 therebetween. Because the multiple shaft-bracket-coupling holes 232 are arranged on a concentric circle about the rear cover through-hole 231, the minimum distance D1 and the maximum distance D2 can be obtained based on the distance between each pair of shaft-bracket-coupling holes 232 that are diametrically opposed to each other in consideration of the diameter of the shaft-bracket-coupling holes 232.

Because half of the outside diameter C2 of the protective cover 25 is larger than the maximum distance among the distances between the center of the rear cover 23 and the plurality of shaft-bracket-coupling holes 232 (half of D2) even when the number of the shaft-bracket-coupling holes 232 is an odd number, it is possible to prevent the rear cover through-hole 231 and the plurality of shaft-bracket-coupling holes 232 from being exposed.

Referring to FIG. 8B, the shaft bracket coupler 235 is depressed or elevated in the forward direction of the drum 2 from the rear surface of the rear cover 23 (the rightmost surface in FIG. 8B) by a first predetermined distance R1. When the shaft bracket 27 is coupled to the region of the rear cover 23 around the rear cover through-hole 231, the shaft bracket 27 can project into the drum 2 from the rear surface of the rear cover 23 by a second predetermined distance R2. Accordingly, because the shaft bracket coupler 235 is elevated by the first distance R1, the shaft bracket 27 can project into the drum 2 by the difference between the second distance R2 and the first distance R1 (R2−R1).

In other words, the shaft bracket 27 can have the shaft-coupling hole 271, which is formed therethrough in the axial direction, and the drum shaft 65 can be coupled to the shaft bracket 27 through the shaft-coupling hole 271 and can be inserted into the drum 2.

Referring to FIG. 8C, the protective cover 25 can include a rear cover rear surface 259, which faces the rear cover 23, and at least one cover hook 2591, which projects in the axial direction from the protective cover rear surface 259 and is inserted into the inner circumferential surface of the rear cover through-hole 231 so as to be coupled thereto in a hooking manner. The cover hook 2591 can prevent the protective cover 25 from being separated from the rear cover through-hole 231, and can be in close contact with the rear cover 23. Consequently, it is possible to prevent laundry from being jammed between the rear cover 23 and the cover hook 2591.

The protective cover 25 can further include a cover-reinforcing rib 252, which is positioned on the protective cover rear surface 259 so as to radially surround the cover hook 2591 and to support the protective cover 25. Because the protective cover 25 is configured to have a dome form, which is depressed in a particular direction, the protective cover 25 can have reduced strength. In order to compensate for the reduction in strength, the protective cover 25 can include the cover-reinforcing rib 252. In order to prevent the cover-reinforcing rib 252 from being exposed to the outside, the cover-reinforcing rib 252 can be provided at the protective cover rear surface 259.

The cover-reinforcing rib 252 can include a plurality of cover-reinforcing ribs, which are concentrically arranged about the cover-coupling hole 251.

FIG. 9 is an exploded view illustrating main components assembled with the rear cover.

The protective cover 25 can have the cover-coupling hole 251, which is formed through the center thereof in the axial direction. The drum shaft 65 can have the cover-positioning hole 653, which is formed in the axial direction in the end thereof that is inserted into the drum 2 so as to correspond to the cover-coupling hole 251. The protective cover fastening member 255 can be threaded in the cover-positioning hole 653 through the cover-coupling hole 251.

As described above, when the shaft bracket 27 is coupled to the rear cover 23, a portion of the shaft bracket 27 can be inserted into the drum 2 through the rear cover through-hole 231. In other words, the drum shaft 65 can be inserted into the shaft-coupling hole 271, can be coupled to the shaft bracket 27, and can project into the drum 2.

The drum shaft 65 can include the drum shaft flange 655, which extends radially from the outer circumferential surface of the drum shaft 65, a drum shaft insertion portion 651 including a drum shaft thread 6511, which is formed in the outer circumferential surface thereof between the end of the drum shaft 65 that is inserted into the shaft-coupling hole 271 and the drum shaft flange 655, and a drum shaft transmission portion 657 coupled to the shaft bracket 27 between the drum shaft thread 6511 and the drum shaft flange 655. When the drum shaft 65 is coupled to the shaft bracket 27 and the rear cover 23, the drum shaft insertion portion 651 can be inserted into the shaft-coupling hole 271, and can project into the drum 2.

When the drum shaft 65 is coupled to the shaft-coupling hole 271, the drum shaft flange 655 can come into contact with the rear surface of the shaft bracket 27, thereby preventing the drum shaft 65 from being further inserted.

Because the outside diameter of the shaft bracket 27 is larger than the inside diameter of the rear cover through-hole 231, the shaft bracket 27 can be fixed to the rear surface of the rear cover 23 while closing the rear cover through-hole 231.

The radius of the shaft-coupling hole 271 can be smaller than the radius of the drum shaft flange 655 but can be equal to or larger than the radius of the drum shaft insertion portion 651. Therefore, the drum shaft insertion portion 651 can freely pass through the shaft-coupling hole 271 but may not pass through the drum shaft flange 655. The shaft bracket coupler 235 can be configured to have a shape corresponding to the shape of the shaft-coupling hole 271. Accordingly, when the inner circumferential surface of the shaft-coupling hole 271 has, for example, a serrated shape, the outer circumferential surface of the shaft bracket coupler 235 can be provided with a serrated shape corresponding to the serrated shape of the shaft-coupling hole 271 so as to be engaged therewith.

The reason for this is because the drum shaft insertion portion 651 must be coupled to the shaft-coupling hole 271 so as to transmit the rotational force of the drum shaft 65 to the shaft bracket 27. Accordingly, in order to transmit the rotational force without slipping therebetween, the corresponding surfaces between the drum shaft insertion portion 651 and the shaft-coupling hole 271 can have corresponding toothed or serrated forms.

The outer circumferential surface of the drum shaft insertion portion 651 can be provided with the drum shaft thread 6511. The reason for this is to couple the shaft bracket 27 to the drum shaft 65 via a coupling nut or a rotating-shaft-coupling member 26 when the drum shaft insertion portion 651 is inserted into the shaft-coupling hole 271 and projects into the drum 2. For example, the rotating-shaft-coupling member 26 can have a cylindrical shape and protrude from a front surface of the shaft bracket 27 toward the drum. The rotating-shaft-coupling member 26 defines an inner thread at an inner circumferential surface thereof, and an end portion of the drum shaft 65 has an outer thread coupled to the inner thread.

The rotating-shaft-coupling member 26 can also be received in the protective cover 25 so as not be exposed by virtue of the depressed shape of the protective cover 25.

The protective cover 25 can have the cover-coupling hole 251 formed through the center thereof. The drum shaft 65 can have the cover-positioning hole 653, which is formed in the axial direction in the end of the drum shaft 65 that is inserted into the drum 2 so as to correspond to the cover-coupling hole 251. Accordingly, the protective cover 25 can be fixed to the drum shaft 65 through the cover-coupling hole 251 and the cover-positioning hole 653.

The protective cover 25 can be coupled to the drum shaft 65 in any manner other than in the screwing manner as long as the protective cover 25 is capable of being coupled to the drum shaft 65 and rotated therewith. Because why the protective cover 25 is coupled to the drum shaft 65 is to cause the protective cover 25 to be rotated at the same speed as the drum 2, the protective cover 25 can be coupled to the rear cover 23 rather than the drum shaft 65.

When the drum shaft insertion portion 651 is coupled to the shaft-coupling hole 271, a drum shaft washer 28 can further be interposed between the drum shaft flange 655 and the shaft bracket 27. When the drum shaft washer 28 is fitted over the drum shaft 65 and the drum shaft insertion portion 651 is coupled to the shaft-coupling hole 271, the drum shaft washer 28 can be positioned between the drum shaft flange 655 and the shaft bracket 27. The drum shaft washer 28 can serve to reduce frictional force generated between the drum shaft flange 655 and the shaft bracket 27 when the drum shaft 65 is engaged with the shaft bracket 27 and rotated therewith.

Figure 10B:
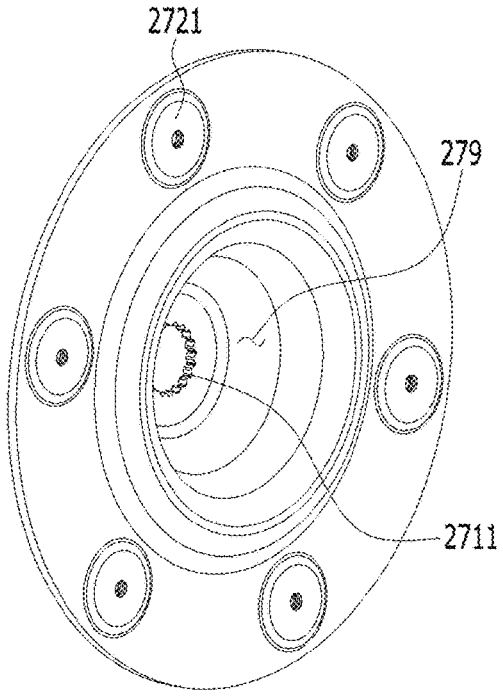

FIGS. 10A and 10B illustrate an example of the shaft bracket 27 when viewed from the front and the rear. The shaft bracket 27 can include a shaft coupler 278, which has the shaft-coupling hole 271, in which the drum shaft 65 is coupled, and which defines the central portion of the shaft bracket 27, a shaft bracket flange 275, which extends in a radially outward direction of the shaft coupler 278 and is fixed to the rear cover 23, and a shaft bracket sloping portion 277 obliquely extending between the shaft coupler 278 and the shaft bracket flange 275 and connecting the shaft coupler 278 and the shaft bracket flange 275 to each other.

In other words, the shaft bracket 27 can include the ring-shaped shaft coupler 278 having the shaft-coupling hole 271, the shaft bracket flange 275, which is radially spaced apart from the shaft coupler 278 based on the shaft-coupling hole 271 and is fixed to the rear cover 23, and the shaft bracket sloping portion 277, which obliquely extends between the shaft coupler 278 and the shaft bracket flange 275 and connects them to each other.

The shaft coupler 278 can be configured to have a ring-shaped flat plate having the shaft-coupling hole 271 formed through the center thereof. The ring-shaped flat plate (or the ring flat plate) can serve as a stopper which catches on the drum shaft flange 655 when the drum shaft 65 is inserted into the shaft-coupling hole 271.

The inner circumferential surface of the shaft-coupling hole 271 can have a serrated shape or a toothed shape. The outer circumferential surface of the drum shaft insertion portion 651 of the drum shaft 65 can also have a shape corresponding to the serrated or toothed shape of the shaft-coupling hole 271 such that the drum shaft 65 is engaged with the shaft-coupling hole 271 so as to transmit rotational force. The shaft coupler 278 including the shaft-coupling hole 271 can project in the forward direction of the drum 2 further than other portion of the shaft bracket 27. Consequently, the shaft coupler 278 can be inserted into the rear cover through-hole 231, and can be coupled to the drum shaft 65, thereby reducing the size of the assembly of the drum 2 and the drive unit 10.

When the shaft coupler 278 including the shaft-coupling hole 271 is positioned in the center of the shaft bracket 27, the shaft bracket flange 275, which is provided in a radial direction of the shaft-coupling hole 271, can have a plurality of rear-cover-coupling hole 272 formed through the shaft bracket flange 275 for coupling to the rear cover 23.

Referring to FIG. 9, the rear cover 23 can have the plurality of shaft-bracket-coupling holes 232, which are arranged around the rear cover through-hole 231 so as to respectively correspond to the plurality of rear-cover-coupling holes 272. The rear cover 23 and the shaft bracket 27 can be coupled to each other by means of the bracket-coupling member 225 after the plurality of shaft-bracket-coupling holes 232 are respectively aligned with the plurality of rear-cover-coupling holes 272.

The shaft bracket sloping portion 277 can include a first sloping portion 2771, which radially and obliquely extends from the shaft coupler 278, and a second sloping portion 2772, which radially extends from the first sloping portion 2771 and is connected to the shaft bracket flange 275.

Referring to FIG. 10A, the first sloping portion 2771 can be inclined outwards moving in a direction away from the rear cover 23 in the axial direction. In other words, the first sloping portion 2771 can be configured so as to increase in cross-sectional area moving radially outwards from the shaft-coupling hole 671. In other words, the first sloping portion 2771 can be configured to have a cone-shaped outer surface having a cross-sectional area, which increases moving radially from the shaft-coupling hole 671. In some examples, the second sloping portion 2772 can be inclined in a direction opposite the direction in which the first sloping portion 2771 is inclined, and can connect the first sloping 2771 to the shaft bracket flange 275.

The portion of the shaft bracket 27 at which the first sloping portion 2771 is connected to the second sloping portion 2772 can be positioned so as to be closer to the motor 5 than to the rear cover 23 based on the shaft bracket flange 275. Accordingly, when the shaft bracket 27 is placed on the ground surface, the portion of the shaft bracket 27 at which the first sloping portion 2771 is connected to the second sloping portion 2772 can come into contact with the ground surface.

Referring to FIGS. 8C and 10B, the first cone-shaped sloping portion 2771, which increases in cross-sectional area moving away from the shaft-coupling hole 271, can define the drum shaft reception space 279 capable of accommodating the drum shaft 65 when viewed from the rear. The reason for this is to correspond to the contour of the power transmission unit 6 and to thus minimize the space occupied by the power transmission unit 6. In other words, the drum shaft reception space 279 can accommodate the drum shaft 65 connected to the power transmission unit 6, the housing cover 63, and a portion of an insulator.

Because the portion of the shaft bracket 27 at which the first sloping portion 2771 is connected to the second sloping portion 2772 is positioned so as to be closer to the motor 5 than to the rear cover 23 based on the shaft bracket flange 275, the first sloping portion 2771 and the second sloping portion 2772 can define a shaft bracket recess 276. In other words, the shaft bracket recess 276 can be a depressed portion defined between the first sloping portion 2771 and the shaft bracket flange 275.

Referring to FIG. 8B, the distance B2 between the cover hook 2591 and the shaft bracket recess 276 can be greater than the distance B1 between the cover hook 2591 and the shaft bracket flange 275.

The shaft bracket recess 276 is intended to accommodate the hook portion when the cover hook 2591 is engaged with the rear cover through-hole 231. Specifically, the inner circumferential surface of the rear cover 23 may not be formed by merely forming a circular hole in the rear cover 23 by cutting the rear cover 23 but can be formed by forming a circular hole in the rear cover 23 by cutting the rear cover 23 and then bending a portion of the inner circumferential surface of the rear cover through-hole 231 that corresponds to the cover hook 2591 in a direction of the rear surface of the rear cover 23. Accordingly, there is a need to design the shaft bracket 27 in consideration of the case in which the cover hook 2591 is engaged with the rear cover through-hole 231. In some examples, the shaft bracket 27 can include the shaft bracket recess 276.

Referring to FIG. 10B, the plurality of rear-cover-coupling holes 272 can be depressed toward the rear surface of the shaft bracket 27. The reason for this is to minimize projection of the head of the bracket-coupling member 225 from the shaft bracket 27 when the plurality of shaft-bracket-coupling holes 232 are aligned with the plurality of rear-cover-coupling holes 272 and are coupled thereto via the bracket-coupling member 225. When the dome-shaped protective cover 25 is coupled to the rear cover 23, the bracket-coupling member 225 will be positioned at the highest portion of the protective cover 25 rather than at the center of the protective cover 25. The reason for this is because the height of the peripheral portion of the protective cover 25 is lower than the height of the central portion of the protective cover 25 and thus because the bracket-coupling member 225 can interfere with the protective cover 25 when the bracket-coupling member 225 excessively projects.

FIGS. 11A and 11B are views of the rear cover 23 when viewed from the front surface and the rear surface thereof.

Referring to FIG. 11A, the rear cover 23 can include the rear cover through-hole 231 formed in the center thereof, through which the shaft bracket 27 is inserted, the plurality of shaft-bracket-coupling holes 232, which are formed through the rear cover 23 and are arranged around the rear-cover-coupling hole 272 at regular intervals, and the shaft-bracket-coupling portion 235, which has the rear cover through-hole 231 and the plurality of shaft-bracket-coupling holes 232 formed in the rear cover 23 and which is elevated in the forward direction of the drum 2 and is coupled to the protective cover 25.

The shaft-bracket-coupling portion 235 can project in the forward direction of the drum 2 further than the portion in which the air introduction hole 233 is formed. The reason for this is to reduce the volume occupied by the drive unit when the drive unit 10 is positioned behind the drum 2. In other words, the drum shaft 65 of the drive unit 10, particularly, the power transmission unit 6 projects forwards. The projecting portion can be received in the drum shaft reception space defined by the depressed portion of the shaft-bracket-coupling portion 235. Subsequently, the drum shaft 65 and the shaft bracket 27 can be received in the rear surface recess 2311 (see FIG. 11B) formed in the rear coupling surface 2352, which is the rear surface of the rear cover 23, thereby reducing the size of the assembly of the drum 2 and the drive unit 10.

The rear cover 23 can include the plurality of rear-cover-reinforcing ribs 237, which extend radially from the shaft-bracket-coupling portion 235 like spokes and are connected to the periphery of the rear cover 23. The rear-cover-reinforcing ribs 237 are intended to increase the strength of the rear cover 23. The plurality of air introduction holes 233 can be formed through the rear cover 23 between the plurality of rear-cover-reinforcing ribs 237.

As described above, the supply duct 321, which is provided at the fixed panel 151 and defines the transfer passage for the air discharged from the second duct 312, can guide the air in the supply duct 321 to the air introduction hole 233 through the first passage-defining portion 323 and the second passage-defining portion 324.

The height of the plurality of the rear-cover-reinforcing ribs 237 can be equal to or greater than the height of a rear cover rim 2381 based on the height of the introduction plate 234. The reason for this is because the rear cover rim 2381 can prevent laundry from being positioned close to the inner circumferential surface of the drum body when the height of the rear cover rim 2381 is greater than the height of the introduction plate 234.

FIG. 11A illustrates an example in which the height of the rear-cover-reinforcing ribs 237 is equal to the height of the rear cover rim 2381 based on the introduction plate 234.

The length V1 of the rear cover rim 2381 in the radial direction can be less than the length V2 of the introduction plate 234 in the radial direction. The reason for this is to supply sufficient hot air to the inside of the drum 2. Furthermore, the reason for this is because the rear cover rim 2381 is heated by the hot air, thereby causing damage to the laundry when the length of the rear cover rim 2381 is greater than the length V2 of the introduction plate 234.

The introduction plate 234 can be formed in the area defined by the rear cover rim 2381, the rear cover central portion 236, and the plurality of rear-cover-reinforcing ribs 237. Consequently, it is possible to efficiently supply hot air to the inside of the drum 2 while reinforcing the rigidity of the rear cover 23.

The height of the plurality of rear-cover-reinforcing ribs 237 can be less than the height of the rear cover central portion 236. In other words, the height of the plurality of rear-cover-reinforcing ribs 237 can be equal to or less than the height of a central flat surface 2361 in which the rear cover through-hole 231 is positioned.

In order to prevent damage to laundry, the portions at which the plurality of rear-cover-reinforcing ribs 237 meet the introduction plate 234 can be rounded.

The shaft bracket 27 can be fixed to the shaft-bracket-coupling portion 235. As described above, when the shaft bracket 27, which projects toward the rear cover 23, is fixed to the rear cover 23, the portion of the shaft bracket 27 including the shaft-coupling hole 271 can be inserted into the rear cover through-hole 231 and can project into the drum 2.

The protective cover 25 can be coupled to a coupling front surface, which defines the front surface of the shaft-bracket-coupling portion 235. In other words, the protective cover 25 can be coupled to the rear cover central portion 236.

The cover hook 2591 can be engaged with the rear cover through-hole 231. Here, for engagement with the cover hook 2591, the portion of the inner circumferential surface of the rear cover through-hole 231 that is engaged with the cover hook 2591, can be bent toward the rear surface of the rear cover 23 such that the cover hook 2591 is engaged with the bent portion of the circumferential surface of the rear cover through-hole 231. Accordingly, the shaft bracket 27, which is coupled to the rear coupling surface 2352, can include the shaft bracket recess 276.

As described above, in order to minimize projection of the head of the bracket-coupling member 225 from the shaft bracket 27 when the plurality of shaft-bracket-coupling holes 232 and the plurality of rear-cover-coupling holes 272 are coupled to each other by means of the bracket-coupling member 225, the plurality of shaft-bracket-coupling holes 232 can also depressed. Accordingly, the plurality of rear-cover-coupling holes 272 can also be depressed.

Referring to FIGS. 11A and 11B, introduction plate 234, which are depressed toward the rear surface of the rear cover 23, can be formed between the plurality of rear-cover-reinforcing ribs 237. The plurality of air introduction holes 233 can be positioned at the introduction plate 234. The reason for this is because the air introduction holes 233 can be blocked by laundry during rotation of the drum 2 when the air introduction holes 233 are positioned at same surface as the rear-cover-reinforcing ribs 237. In addition, in order to swirl hot air introduced through the air introduction holes 233, it is advantageous that the rear-cover-reinforcing ribs 237 and the air introduction holes 233 are formed in the same level rather than in different levels.

The rear coupling surface 2352, which defines the rear surface of the shaft-bracket-coupling portion 235, can be coupled to the shaft bracket 27. Specifically, the shaft bracket flange 275 can be coupled to the rear coupling surface 2352.

The rear cover 23 can include a rear cover side surface defining the side surface thereof. The reason for this is to facilitate coupling of the rear cover 23 to the drum body 21.

Alternatively, the rear cover 23 can include the rear cover through-hole 231, through the shaft bracket 27 and the drum shaft 65 are inserted, and the plurality of shaft-bracket-coupling holes 232 formed around the rear cover through-hole 231. The shaft bracket 27 can include the plurality of rear-cover-coupling holes 272, the number of which is the same as the number of shaft-bracket-coupling holes 232 so as to respectively correspond to the plurality of shaft-bracket-coupling holes 232. After the shaft bracket 27 and the rear cover 23 can be positioned such that the plurality of rear-cover-coupling holes 272 are aligned with the plurality of shaft-bracket-coupling holes 232, the shaft bracket 27 and the rear cover 23 can be coupled to each other by means of the bracket-coupling member 225. As a result, the shaft bracket 27 can be fixed to the rear cover 23, and can close the rear cover through-hole 231.

The protective cover 25 can be configured to have a dome form so as to shield the shaft bracket 27 and the drum shaft 65. In other words, the protective cover 25 can be depressed in the axial direction away from the rear cover 23. Accordingly, the rear surface of the protective cover 25, that is, the protective cover rear surface 259 can cover a predetermined area defined about the center of the rear cover through-hole 231.

The predetermined area of the rear cover through-hole 231, which is covered by the protective cover 25, means an area including the rear cover through-hole 231, which is not exposed to the outside when the protective cover 25 covers the rear cover 23.

Referring to FIG. 7A, the predetermined area, which is covered by the protective cover 25, can be a circular area including the rear cover through-hole 231 and the plurality of shaft-bracket-coupling holes 232. Accordingly, FIG. 7A illustrates an example where the protective cover 25 covers the shaft bracket 27, the drum shaft 65, and the bracket-coupling member 225.

Unlike this, the periphery of the protective cover 25 is positioned between the rear cover through-hole 231 and the plurality of shaft-bracket-coupling holes 232 so as to prevent exposure of the rear cover through-hole 231 but to allow exposure of the plurality of shaft-bracket-coupling holes 232 to the outside.

The reason for this is because the plurality of the shaft-bracket-coupling holes 232 are aligned with the plurality of rear-cover-coupling holes 272 and are coupled thereto by means of bracket-coupling member 225 and thus the plurality of shaft-bracket-coupling holes 232 are closed by the bracket-coupling member 225. Therefore, it is difficult for the moisture contained in laundry to have an influence on the drive unit through the plurality of shaft-bracket-coupling holes 232. Consequently, although the protective cover 25 may not cover the plurality of shaft-bracket-coupling holes 232, the main function of the protective cover 25 of preventing exposure of the drum shaft 65 and the shaft bracket 27 may not be deteriorated.

Accordingly, the periphery of the protective cover 25 can be positioned between the rear cover through-hole 231 and the plurality of shaft-bracket-coupling holes 232 so as to prevent exposure of the rear cover through-hole 231 but to allow exposure of the plurality of shaft-bracket-coupling holes 232 to the outside.

In other words, the radius of the protective cover 25, which is the half of the outside diameter of the protective cover 25, can be larger than the outside diameter of the rear cover through-hole 231 but can be smaller than the minimum distance between the center of the rear cover 23 and the plurality of shaft-bracket-coupling holes 232.

In some implementations, in order to prevent laundry from being damaged by the projecting bracket-coupling member 225, the bracket-coupling member 225 may not project from the rear cover 23 when the plurality of shaft-bracket-coupling holes 232 are coupled to the plurality of rear-cover-coupling holes 272, which respectively correspond to the plurality of shaft-bracket-coupling holes 232, by means of the bracket-coupling member 225.

When the bracket-coupling member 225 is, for example, a screw, each of the plurality of shaft-bracket-coupling holes 232 and the plurality of rear-cover-coupling holes 272 corresponding to the shaft-bracket-coupling holes 232 can be depressed so as to correspond to the head of the screw such that the head of the screw is received in each of the plurality of shaft-bracket-coupling holes 232.

In other words, the plurality of shaft-bracket-coupling holes 232 can be depressed toward the rear surface of the rear cover 23 so as to prevent the bracket-coupling member 225 from projecting from the rear cover 23.

FIG. 11C illustrates the difference G between the introduction plate 234 and the rear cover rim 2381 or the rear-cover-reinforcing ribs 237 and the difference K1 between the rear-cover-reinforcing ribs 237 and the central flat surface 2361.

The rear-cover-reinforcing ribs 237 can project toward the inside of the drum from the introduction plate 234. The rear cover central portion 236 can be depressed inwards further than the rear-cover-reinforcing ribs 237.

Referring to FIG. 11C, the height of a rear cover side surface 2382 can be greater than the depth to which the rear cover central portion 236 is depressed from the rear cover rim 2381.

Figure 12A:
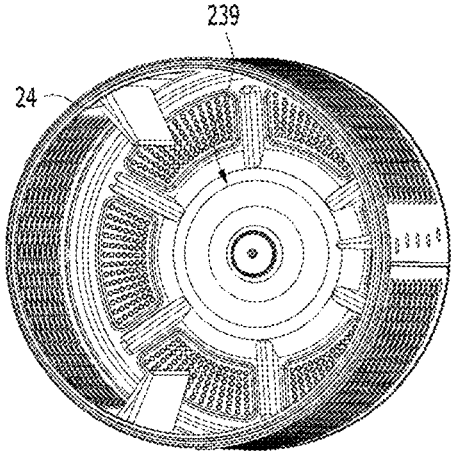
FIGS. 12A and 12B illustrate another example of the rear-cover-reinforcing rib.
Figure 12B:
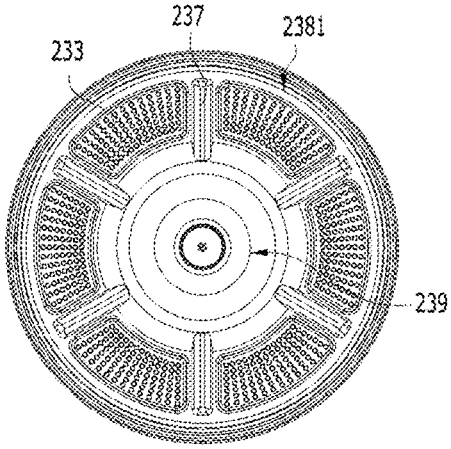

FIGS. 12A and 12B illustrate another implementation of the rear cover 23. A lifter 24 can extend in the axial direction toward the rear cover 23 from the drum entrance 221. The lifter 24 can be configured to have a plate form projecting toward the rotational center of the drum 2. The length of the drum 2 in the radial direction can be greater than the length of the lifter in the radial direction shown in FIG. 7A. Consequently, the hot air in the drum 2 can be efficiently mixed during rotation of the drum 2 such that the rotating hot air efficiently transmits heat to the laundry in the drum 2.

For efficient rotation of the hot air, the height of the plurality of rear-cover-reinforcing ribs 437 can be equal to or greater than the height of the rear cover rim 438 based on the rear cover recesses. The reason for this is because the rear cover rim 2381 can prevent laundry from being positioned close to the inner circumferential surface of the drum body when the height of the rear cover rim 2381 is greater than the height of the rear-cover-reinforcing ribs 237.

FIG. 11A illustrates an example in which the height of the rear-cover-reinforcing ribs 237 is equal to the height of the rear cover rim 2381 based on the introduction plate 234. In some examples, FIG. 12B illustrates an example in which the height of the rear-cover-reinforcing ribs 437 is greater than the height of the rear cover rim 4381. This implementation can be more efficient for rotating hot and dry air introduced into the drum 2.

Because conventional components, which would, if present, be positioned below the drum 2, are replaced with the drying unit 3, the volume occupied by the drying unit 3 can increase. Particularly, when the cross-sectional area of the passages (the exhaust passage 31 and the supply passage 32), through which air currents, increases, the capacity of a fan 349 disposed in at least one of the passages can be increased.

When the capacity of the fan 349 increases, the intensity of the air current flowing in the passages increases. In this case, the hot air, which is introduced into the drum body 21 through the air introduction holes 233, can move the laundry positioned in the drum body 21 forwards.

When the laundry positioned in the drum body 21 is moved forwards, there can be problems in which it is difficult for hot air to come into contact with the entire laundry and in which the laundry, which is moved forwards, blocks the exhaust port 126.

Figure 13:
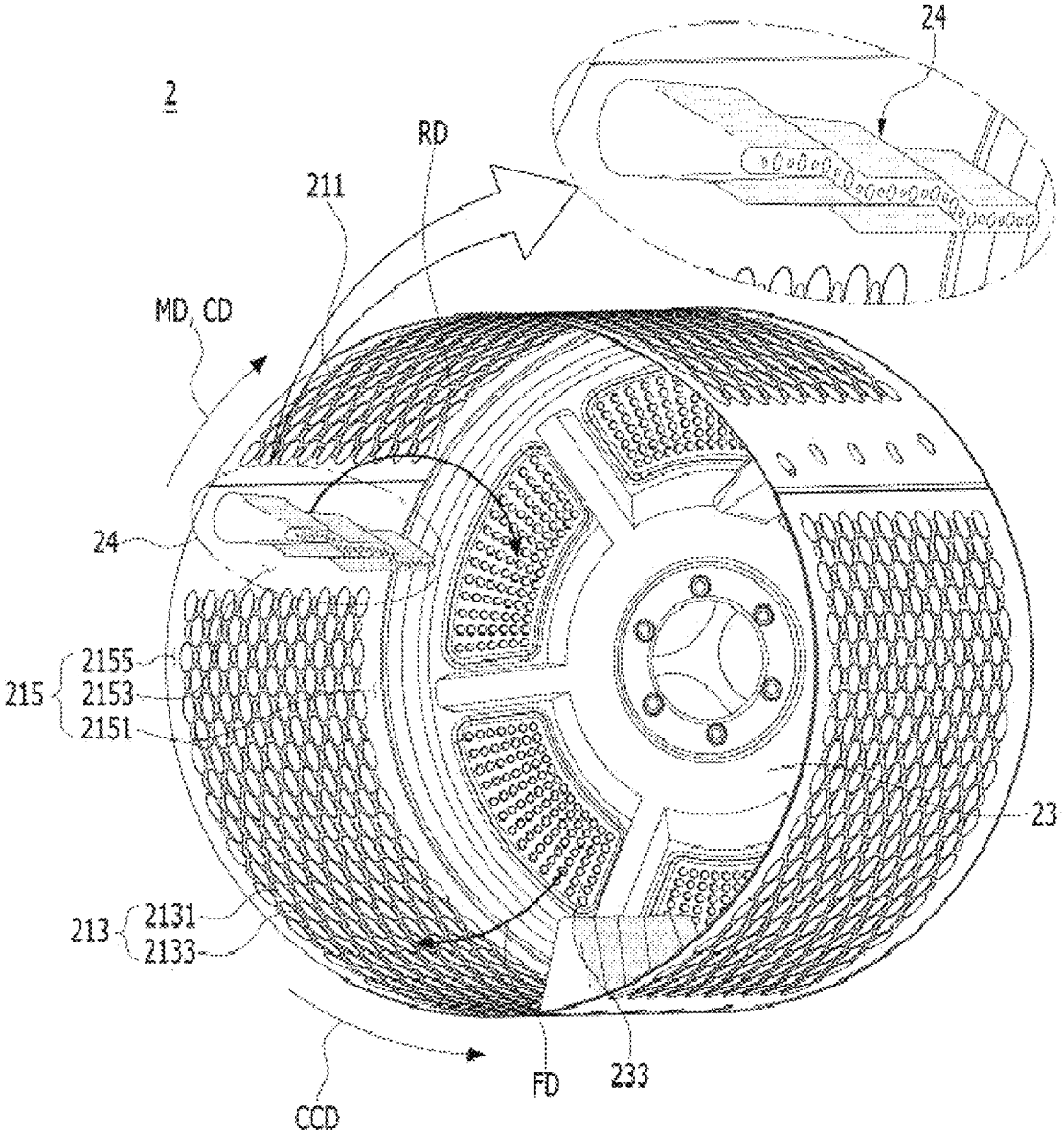
FIG. 13 is a perspective view showing an example of a drum body.

FIG. 13 illustrates the shape of the lifter 24 capable of solving the above-mentioned problems. Specifically, FIG. 13 illustrates the lifter 24, and additionally illustrates the lifter 24 in an enlarged view.

As illustrated in FIG. 13, the lifter 24 can be coupled to the inner circumferential surface of the drum body 21 so as to agitate laundry during rotation of the drum body 21. The lifter 24 can extend toward the front end from the rear end of the drum body 21. Here, the lifter 24 can be spaced apart from both the rear cover 23 and the front cover 22.

The lifter 24 can extend toward the front cover 22 from the rear cover 23, and can include a portion which is inclined in the main rotational direction MD of the drum 2.

As described above, the rotational direction of the drum 2 can be changed. The main rotational direction of the drum 2 refers to the direction in which the drum 2 is mainly rotated. Specifically, the laundry treatment apparatus 100 can perform a drying procedure of supplying heated air or moisture in order to remove moisture or wrinkles from laundry. The main rotational direction of the drum 2 can be the direction in which the drum 2 is dominantly rotated in the drying procedure.

Alternatively, the main directional direction MD can be the direction in which the drum 2 is dominantly rotated during a portion of the drying procedure. Specifically, a period of time may be spent heating air in the initial stage of the drying procedure, and the temperature of laundry may be almost equal to the temperature of air, thus deteriorating drying efficiency, in the terminating stage of the drying procedure. Accordingly, the main rotational direction MD can be the direction in which the drum 2 is dominantly rotated during the interval between the point at which a predetermined period of time has elapsed since the starting point of the drying procedure and the point before a predetermined period of time from the ending point of the drying procedure.

In some examples, one of the clockwise direction CD and the counterclockwise direction CCD can be set to be the main rotational direction, and the drive unit 10 can rotate the drum 2 in the main rotational direction. Specifically, the drive unit 10 can be set so as to dominantly rotate the drum 2 in one direction among the clockwise direction CD and the counterclockwise direction CCD during the drying procedure.

The lifter 24 can be configured to have one of various forms. The specific form of the lifter 24 will be described in detail with reference to FIG. 9 and subsequent drawings.

Consequently, the lifter 24 can guide the laundry positioned in the drum 2 in the rearward direction RD toward the rear cover 23 when the drum 2 is rotated in the main rotational direction MD.

The lifter 24 is capable of agitating the laundry positioned in the drum 2 not only in the clockwise direction CD and in the counterclockwise direction CCD but also in the rearward direction RD. Consequently, when the drum 2 is rotated in the main rotational direction MD, it is possible to more efficiently dry the laundry positioned in the drum 2.

When the lifter includes the sloped portion, which is sloped in the main rotational direction MD, there can be a problem in which the laundry in the drum 2 is concentrated toward the rear cover 23.

In order to solve the problem in which laundry is concentrated in one direction, the inner circumferential surface 211 of the drum body 21 can be provided with an anti-slip portion 213 configured to prevent slippage of the laundry and a slip-inducing portion 215 configured to induce slippage of the laundry.

The anti-slip portion 213 can be configured to be convex or concave from the inner circumferential surface of the drum body 210.

The slip-inducing portion 215 can be defined as a portion which is defined on the inner circumferential surface 211 of the drum body 21 by the anti-slip portion 213. In other words, the slip-inducing portion 215 can be a portion on the inner circumferential surface 211 of the drum body 21 in which the anti-slip portion 213 is not formed. Here, the slip-inducing portion 215 can be a curved surface having a predetermined curvature.

The anti-slip portion 213 can include a first anti-slip portion 2131, which is convex from the inner circumferential surface 211 of the drum body 21, and a second anti-slip portion 2133, which is concave from the inner circumferential surface 211 of the drum body 21 and has a size smaller than the first anti-slip portion 2131.

Each of the first anti-slip portion 2131 and the second anti-slip portion 2133 can include a plurality of anti-slip portions, and the plurality of first anti-slip portions 2131 and the plurality of second anti-slip portions 2133 can be alternately arranged.

The anti-slip portions 213 can extend forwards and rearwards on the inner circumferential surface 211 of the drum body 21. Here, the anti-slip portions 213 can extend from a location spaced apart from the rear cover 23 to a location spaced apart from the front cover 22. The reason for this is to prevent the laundry positioned in the drum 2 from being concentrated toward one of the front cover 22 and the rear cover 23.

The anti-slip portions 213 can extend forwards and rearwards on the inner circumferential surface 211 of the drum body 21, and can be spaced apart from each other in the circumferential direction. The lifter 24 can be positioned between the anti-slip portions 213.

The slip-inducing portion 215 can include a first slip-inducing portion 2151, which extends not only in the longitudinal direction of the drum shaft 65 but also in the clockwise direction CD or in the counterclockwise direction CCD at the rear end of the drum body 21, a second slip-inducing portion 2153 extending from the first slip-inducing portion 2151 in the longitudinal direction of the drum shaft 65, and a third slip-inducing portion 2155, which extends in the clockwise direction CD or in the counterclockwise direction CCD from the distal end of the second slip-inducing portion 2153.

The lifter 24 can be coupled to the second slip-inducing portion 2153.

Accordingly, the lifter 24 can easily come into contact with the laundry positioned in the drum 2. The first slip-inducing portion 2151 can assist the heated air, which is introduced through the air introduction holes 233, in moving in the forward direction FD and in pushing the laundry positioned at the rear cover 23. Consequently, even when the lifter 24 guides the laundry positioned in the drum 2 toward the rear cover 23, it is possible to prevent a phenomenon in which heated air may not be introduced into the drum 2 because the laundry is concentrated to the rear cover 23.

On the other hands, the rear cover 23 can include a rear cover central portion 236, which projects forwards and to which the drum shaft 65 is coupled, a plurality of rear-cover-reinforcing ribs 237 radially extending from the rear cover central portion 236, and an introduction plate 234, which is provided between the plurality of rear-cover-reinforcing ribs 237 and through which the air introduction holes 233 are formed.

The rear cover central portion 236 can project toward the front cover 22 from the center of the surface of the rear cover 23 that faces the front cover 22.

The rear cover central portion 236 can include a coupling plate 2311, which is spaced apart from the plurality of rear-cover-reinforcing ribs 237 toward the front cover 22 and to which the drum shaft 65 is fixed, and a mounting-space-defining portion 2313, which extends toward the plurality of rear-cover-reinforcing ribs 237 from the coupling plate 2311 so as to define a space for receiving the drum shaft 65 therein.

The rear cover central portion 236 can be rounded. Consequently, it is possible to prevent the laundry, which is guided to the rear cover 23 by the lifter 24, from becoming stuck in the rear cover central portion 236.

The plurality of rear-cover-reinforcing ribs 237 can radially extend from the outer periphery of the mounting-space-defining portion 2313. Here, the plurality of rear-cover-reinforcing ribs 237 can be spaced apart from each other at regular intervals and can extend. FIG. 8 illustrates an example in which six rear-cover-reinforcing ribs 237 are spaced apart from one another at regular intervals.

The introduction plate 234 can include a plurality of introduction plates, which are respectively positioned between the plurality of rear-cover-reinforcing ribs 237. FIG. 8 illustrates an example in which six introduction plates 237 are respectively provided between the six rear-cover-reinforcing ribs 237. The plurality of introduction plates 237 can be spaced apart from each other in the circumferential direction so as to surround at least a portion of the rear cover central portion 236.

When a plurality of introduction plates 237 and a plurality of rear-cover-reinforcing ribs 237 are provided, the air introduction holes 233 can be respectively provided in the plurality of introduction plates 237.

Each of the air introduction holes 233 can include a plurality of air introduction holes 233, which is formed through the introduction plate 234 so as to guide heated air into the drum 2, and an rear cover rim 2381 surrounding the plurality of.

The introduction plate 234 can project rearwards from the rear cover rim 2381.

The introduction plate 234 and the rear cover rim 2381 can be spaced apart from the periphery of the rear cover 23. Here, the rear cover 23 can further include an rear cover side surface 2382, which surrounds the plurality of rear-cover-reinforcing ribs 237 and the rear cover rim 2381 and extends to the peripheral edge of the rear cover 23.

As a result, the heated air, which is introduced through the air introduction holes 233, can create a more intensive airflow. The reason for this is because the intensity of airflow, which is capable of being created by the fan 349, is limited, and thus the intensity of heated air, which is introduced through the air introduction holes 233, is increased when the ratio of the area the air introduction holes 233 to the area of the rear cover is decreased.

Particularly, considering that the lifter 24 is capable of agitating the laundry positioned in the drum 2 forwards and rearwards, reducing in the ratio of the area of the air introduction holes 233 to the area of the rear cover can improve the efficiency with which the laundry is agitated forwards and rearwards.

In addition, considering that the rear cover 23 is a rotatable component and the introduction plate 234 projects rearwards, the plurality of rear-cover-reinforcing ribs 237 can agitate the heated air in the drum 2. The reason for this is because the rear-cover-reinforcing ribs 237 projects forwards further than the introduction plate 234 and thus serves as blades configured to agitate the heated air in the drum 2.

Furthermore, considering that the lifter 24 is a component configured to agitate the laundry positioned in the drum 2, the lifter 24 can be positioned at a location spaced apart from the introduction plate 234 in the longitudinal direction of the drum shaft 65. In this case, the heated air introduced through the air introduction holes 233 can easily come into contact with the laundry by means of the lifter 24.

In some implementations, the lifter 24 can be positioned so as to overlap each of the air introduction holes 233 in the longitudinal direction of the drum shaft 65.

Hereinafter, various implementations of the lifter 24 will be described with reference to FIGS. 14 to 16.

Considering that the heated air, which is introduced through the air introduction holes 233, pushes laundry forwards, the lifter 24 can guide the laundry toward the rear cover 23.

Specifically, when the drum 2 is rotated in the main rotational direction MD, the portion of the lifter 24 that is positioned before the center C of the length of the drum body 21 in the longitudinal direction of the drum shaft 65 can guide the laundry positioned in the drum 2 toward the rear cover 23 (agitation of the laundry in the circumferential direction and in forward and rearward directions).

In some examples, when the drum 2 is rotated in the main rotational direction MD, the portion of the lifter 24 that is positioned behind the center C of the length of the drum body 21 in the longitudinal direction of the drum shaft 65 can agitate the laundry positioned at the rear cover 23 in the clockwise direction CD or in the counterclockwise direction CCD (agitation of the laundry only in forward and rearward directions).

The lifter 24 can project toward the rotational center of the drum body 21 from the inner circumferential surface of the drum body 21. Here, the lifter 24 can be tapered in a direction in which the lifter 24 projects from the drum body 21.

The lifter 24 can include a fixed surface 241, which is brought into contact with the inner circumferential surface 211 of the drum body 21, a projecting surface 243, which is spaced apart from the fixed surface 241 toward the rotational center of the drum body 21, and an extending surface 245 extending between the fixed surface 241 and the projecting surface 243.

The fixed surface 241 can serve as a fixed end of the lifter 24, and the projecting surface 243 can serve as a free end of the lifter 24.

When the projecting surface 243 is orthogonally projected in a direction opposite the direction toward the rotational center of the drum body 21, the projecting surface 243 can overlap the fixed surface 241.

Figure 14A:
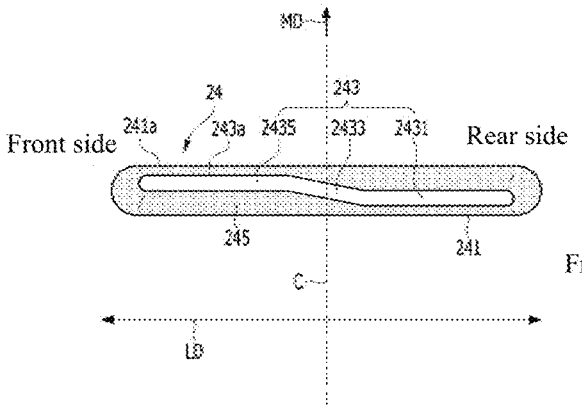
FIGS. 14A and 14B are perspective views showing an example of a lifter.
Figure 14B:
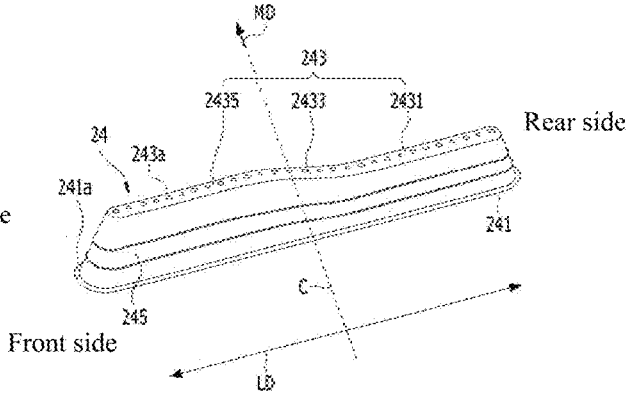

FIG. 14A illustrates an example of the lifter 24 when viewed from the rotational center of the drum 2. FIG. 14B is a perspective view of the lifter 24.

As illustrated in FIGS. 14A and 14B, the portion of the lifter 24 that is positioned before the center C of the length of the drum body 21 in the longitudinal direction LD of the drum shaft 65 may, in the main rotational direction MD, be spaced apart from the portion of the lifter 24 that is positioned behind the center C of the length of the drum body 21 in the longitudinal direction LD of the drum shaft 65.

Specifically, in some implementations, the projecting surface 243 can include a first projecting lifting surface 2431, which extends from the rear side of the drum body 21 in the longitudinal direction LD of the drum shaft 65, a second projecting lifting surface 2433, which extends obliquely from the first projecting lifting surface 2431 in a direction which is inclined in the main rotational direction MD, and a third projecting lifting surface 2435, which extends from the second projecting lifting surface 2433 in the longitudinal direction LD of the drum shaft 65.

In some implementations, the fixed surface 241 can extend from the rear side of the drum body 21 in the longitudinal direction LD of the drum shaft 65. The second projecting lifting surface 2433 can be positioned at the center C of the length of the drum body 21 in the longitudinal direction LD of the drum shaft 65. In some cases, as illustrated in FIG. 15, the lifter 24 can be bent once (the second projecting lifting surface). In other examples, the lifter 24 can be bent twice or more.

Because the direction in which a portion of the projecting surface 243 extends is different from the direction in which the fixed surface 241 extends, the extent to which the extending surface 245 is tapered can vary along the length of the lifter 24. Particularly, because there is a difference in position between the end 241*a* of the fixed surface 241 in the main rotational direction MD and the end 243*a* of the projecting surface 243 in the main rotational direction MD, agitation of laundry can be more facilitated.

Figure 15:
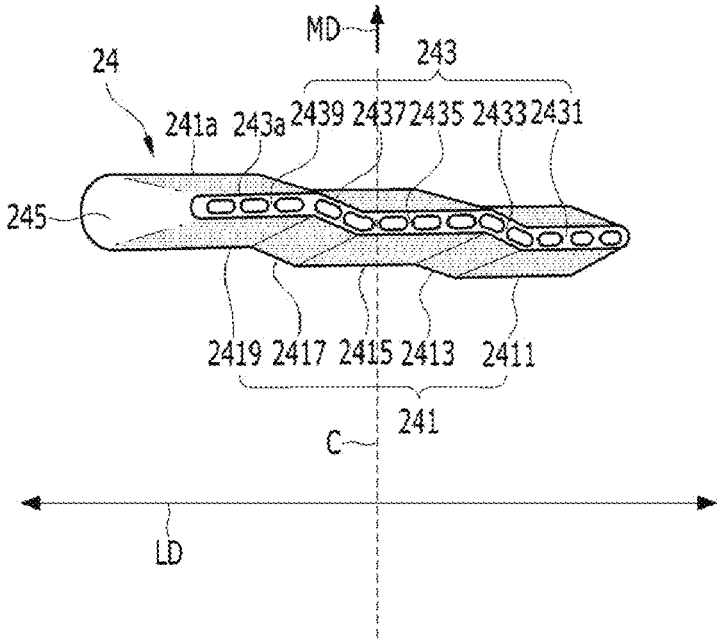
FIG. 15 is a perspective view showing the lifter.

In some implementations, as illustrated in FIG. 15, the lifter 24 can be stepped in the main rotational direction MD moving toward the front side from the rear side of the drum body 21 (referred to as a "stepped shape").

In some examples, the portion of the lifter 24 that is positioned before the center C of the length of the drum body 21 in the longitudinal direction LD of the drum shaft 65 can be spaced apart, in the main rotational direction MD, from the portion of the lifter 24 that is positioned behind the center C of the length of the drum body 21 in the longitudinal direction LD of the drum shaft 65.

In some examples, the projecting surface 243 can include a first projecting lifting surface 2431, which extends from the rear side of the drum body 21 in the longitudinal direction LD of the drum shaft 65, a second projecting lifting surface 2433, which extends from the first projecting lifting surface 2431 in a direction which is inclined in the main rotational direction MD, a third projecting lifting surface 2435, which extends from the second projecting lifting surface 2433 in the longitudinal direction LD of the drum shaft 65, a fourth projecting lifting surface 2437, which extends from the third projecting lifting surface 2435 in a direction which is to inclined in the main rotational direction MD, and a fifth projecting lifting surface 2439, which extends from the fourth projecting lifting surface 2437 in the longitudinal direction LD of the drum shaft 65.

In some examples, the fixed surface 241 can include a first fixed lifting surface 2411, which extends from the rear side of the drum body 21 in the longitudinal direction LD of the drum shaft 65, a second fixed lifting surface 2413, which extends from the first fixed lifting surface 2411 in a direction which is inclined in the main rotational direction MD, a third fixed lifting surface 2415, which extends from the second fixed lifting surface 2413 in the longitudinal direction LD of the drum shaft 65, a fourth fixed lifting surface 2417, which extends from the third fixed lifting surface 2415 in a direction which is inclined in the main rotational direction MD, and a fifth fixed lifting surface 2419, which extends from the fourth fixed lifting surface 2417 in the longitudinal direction LD of the drum shaft 65.

Consequently, the difference in position between the end 241*a* of the fixed surface 241 and the end 243*a* of the projecting surface 243 can be reduced, compared to the previous implementation. Here, although the case in which laundry slips along the extending surface 245 is reduced, the rotational force of the lifter 24 can be more efficiently transmitted to the laundry. In some examples, the lifter 24 can be capable of more easily agitating laundry in forward and rearward directions.

Figure 16A:
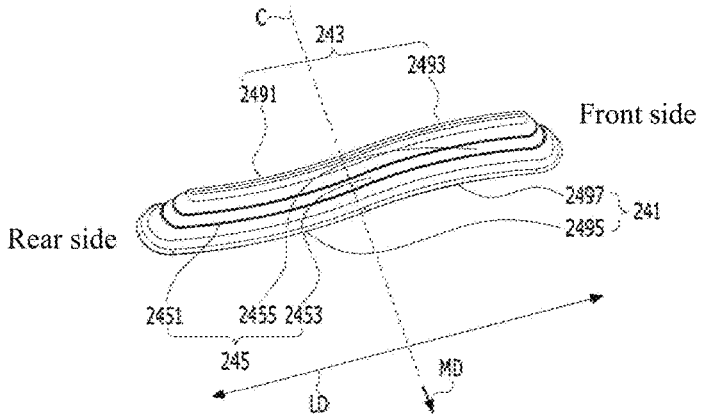
FIGS. 16A and 16B are perspective views showing the lifter.
Figure 16B:
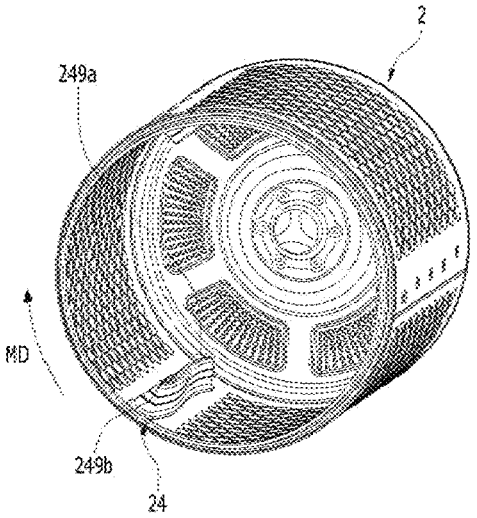

FIG. 16A is a view illustrating an example of the lifter 24. FIG. 16B is a view illustrating the lifter 24 shown in FIG. 16A, which is coupled to the drum 2.

In some implementations, as illustrated in FIGS. 16A and 16B, the lifter 24 can extend forwards from the rear side of the drum body 21 like a wave (that is, in a "wave shape"). In some examples, the front end and the rear end of the lifter 24 can overlap each other in the longitudinal direction LD of the drum shaft 65. In some examples, the projecting surface 243 can include a first projecting laundry-tossing surface 2491, which extends so as to be convex in the main rotational direction MD, and a second projecting laundry-tossing surface 2493, which extends so as to be convex in the direction opposite the main rotational direction MD.

In some implementations, the fixed surface 241 can include a first fixed laundry-tossing surface 2495, which extends so as to be convex in the main rotational direction MD, and a second fixed laundry-tossing surface 2497, which extends so as to be convex in the direction opposite the main rotational direction MD.

In some implementation, the side surface of the extending surface 245 that faces in the main rotational direction MD can include a first extending surface 2451, which extends from the rear side of the drum body 21 in a direction which is inclined in the main rotational direction MD, a second extending surface 2453, which extends from the first extending surface 2451 in a direction which is inclined in the direction opposite the main rotational direction MD, and a third extending surface 2455, which extends from the second extending surface 2453 in a direction which is inclined in the main rotational direction MD.

The first extending surface 2451 can define a first laundry-receiving portion 249*a*, configured to receive laundry therein in order to prevent the laundry positioned at the rear cover 23 from moving forwards, and the second extending surface 2453 and the third extending surface 2455 can define a second laundry-receiving portion 249*b*, configured to receive therein laundry positioned at the front cover 22 and to guide the laundry toward the rear cover 23 by means of the lifter 24.

In some implementations, the lifter 24 can help to prevent laundry positioned at the rear side from being pushed and of allowing laundry positioned at the front side to move rearwards. In some implementations, the laundry treating apparatus can supply hot air while rotating the hot air during rotation of a drum. As a result, it can be possible to improve drying performance by increasing the period of time for which hot air is in contact with laundry.

In some implementations, the laundry treating apparatus can increase the rigidity of a rear cover and thus suppressing twisting of the rear cover.

In some implementations, the laundry treating apparatus can help to prevent laundry from sticking to the rear surface of a drum and thus from being damaged when hot air is supplied.

In some implementations, the laundry treating apparatus can efficiently agitate laundry during rotation of a drum.

In some implementations, the laundry treating apparatus can agitate the laundry positioned in a drum in forward and rearward directions and in the rotational direction of the drum.

In some implementations, the laundry treating apparatus can mix the heated air in a drum in the rotational direction of the drum.

In some implementations, the laundry treating apparatus can help to prevent laundry, which is agitated in a drum, from becoming stuck inside the drum.

It will be apparent to those skilled in the art that various modifications and variations can be made in the present disclosure without departing from the spirit or scope of the disclosure. Thus, it is intended that the present disclosure cover the modifications and variations of this disclosure provided they come within the scope of the appended claims and their equivalents.

What is claimed is:

1. A laundry treatment apparatus comprising:

a drum configured to receive laundry, the drum comprising a drum body that has a cylindrical shape and a rear cover that defines a rear surface of the drum; and a drive unit comprising a drum shaft configured to rotate the drum, wherein the rear cover comprises:

a rear cover central portion that defines a rear cover through-hole passing through the rear cover in an axial direction of the drum shaft, the rear cover central portion protruding toward an inside of the drum, a rear cover peripheral portion that defines an outer circumference of the rear cover, a plurality of rear-cover-reinforcing ribs that connect the rear cover central portion to the rear cover peripheral portion in a radial direction of the drum shaft, and a rear cover recess disposed between the plurality of rear-cover-reinforcing ribs, the rear cover recess being recessed away from the drum relative to the plurality of rear-cover-reinforcing ribs in the axial direction, and wherein the rear cover defines a plurality of air introduction holes at the rear cover recess.

2. The laundry treatment apparatus of claim 1, wherein the rear cover peripheral portion comprises:

a rear cover rim that has a ring shape and is connected to the plurality of rear-cover-reinforcing ribs; and a rear cover side surface that extends radially outward from the rear cover rim, the rear cover side surface being bent from the rear cover rim and coupled to the drum body.

3. The laundry treatment apparatus of claim 2, wherein a distance from the rear cover recess to the rear cover rim in the axial direction is equal to a distance from the rear cover recess to the plurality of rear-cover-reinforcing ribs in the axial direction.

4. The laundry treatment apparatus of claim 2, wherein a radial width of the rear cover rim in the radial direction is less than a radial width of the rear cover recess in the radial direction.

5. The laundry treatment apparatus of claim 2, wherein the rear cover further comprises a plurality of rear cover recesses that are disposed radially between the rear cover rim and the rear cover central portion and disposed between the plurality of rear-cover-reinforcing ribs in a circumferential direction of the rear cover, the rear cover recess being one of the plurality of rear cover recesses.

6. The laundry treatment apparatus of claim 1, wherein a distance from the rear cover recess to the plurality of rear-cover-reinforcing ribs in the axial direction is less than or equal to a distance from the rear cover recess to a portion of the rear cover central portion having the rear cover through-hole in the axial direction.

7. The laundry treatment apparatus of claim 1, wherein the rear cover central portion comprises:

a central flat surface that defines the rear cover through-hole; and a central side surface that extends radially outward from a periphery of the central flat surface and surrounds the central flat surface, and wherein the plurality of rear-cover-reinforcing ribs extend outward from the central side surface in the radial direction.

8. The laundry treatment apparatus of claim 7, wherein the central side surface includes a curved surface.

9. The laundry treatment apparatus of claim 7, wherein a distance from the rear cover recess to the plurality of rear-cover-reinforcing ribs in the axial direction is less than or equal to a distance from the rear cover recess to the central flat surface in the axial direction.

10. The laundry treatment apparatus of claim 1, wherein boundaries of the plurality of rear-cover-reinforcing ribs have a round shape and are connected to the rear cover recess.

11. The laundry treatment apparatus of claim 1, further comprising a lifter disposed on an inner circumferential surface of the drum body and configured to interfere with the laundry based on rotation of the drum, and wherein a longitudinal axis of the lifter passes through the rear cover and is disposed between two of the plurality of rear-cover-reinforcing ribs.

12. The laundry treatment apparatus of claim 11, wherein the lifter extends in the axial direction and has a curved shape.

13. The laundry treatment apparatus of claim 12, wherein the lifter protrudes from the inner circumferential surface of the drum body toward a rotational center of the drum body, and wherein a side surface of the lifter is tapered toward the rotational center of the drum body.

14. The laundry treatment apparatus of claim 11, wherein the lifter extends in the axial direction and has a stepped shape, and wherein the lifter has a plurality of lifting surfaces comprising:

a first lifting surface that extends in the axial direction, a second lifting surface that extends from the first lifting surface and is inclined with respect to the first lifting surface, and a third lifting surface that extends from the second lifting surface in the axial direction to thereby define a step with respect to the first lifting surface in a circumferential direction of the drum body.

15. The laundry treatment apparatus of claim 1, further comprising a drying unit configured to circulate air through the drum, the drying unit being configured to supply the air to the drum to thereby absorb moisture from the laundry.

16. The laundry treatment apparatus of claim 15, wherein the drying unit comprises:

an exhaust passage configured to receive the air discharged from the drum;

a heat-exchanging unit disposed in the exhaust passage and configured to dehumidify the air and then heat the air; and a supply passage configured to guide the air from the exhaust passage toward the drum.

17. The laundry treatment apparatus of claim 1, wherein the drive unit further comprises:

a motor comprising a stator configured to generate a rotating field and a rotor configured to be rotated by the rotating field;

a rotor shaft disposed between the rear cover and the motor, the rotor shaft having one end fixed to the rotor and configured to be rotated by the rotor; and a power transmission unit comprising one or more gears that are configured to transmit rotational power of the rotor shaft to the drum shaft.

18. The laundry treatment apparatus of claim 1, further comprising:

a shaft bracket that is fixed to the rear cover and covers the rear cover through-hole, the shaft bracket being coupled to the drum shaft and configured to transmit rotational power from the drum shaft to the drum; and a rotating-shaft-coupling member that couples the drum shaft to the shaft bracket, wherein the shaft bracket defines a shaft-coupling hole, and the drum shaft is inserted into the shaft-coupling hole and protrudes toward the drum.

19. The laundry treatment apparatus of claim 18, further comprising a protective cover that is disposed in the drum and covers the drum shaft and the shaft bracket.

20. The laundry treatment apparatus of claim 18, wherein the rotating-shaft-coupling member has a cylindrical shape and protrudes from a front surface of the shaft bracket toward the drum, the rotating-shaft-coupling member defining an inner thread at an inner circumferential surface thereof, and wherein an end portion of the drum shaft has an outer thread coupled to the inner thread.

* * * * *